US010702763B2

(12) United States Patent
Chun

(10) Patent No.: US 10,702,763 B2
(45) Date of Patent: Jul. 7, 2020

(54) METHODS AND SYSTEMS FOR PLAYING BACCARAT JACKPOT

(71) Applicant: IGT, Las Vegas, NV (US)

(72) Inventor: Jay Chun, Hong Kong (CN)

(73) Assignee: IGT, Las Vegas, NV (US)

( * ) Notice: Subject to any disclaimer, the term of this patent is extended or adjusted under 35 U.S.C. 154(b) by 118 days.

(21) Appl. No.: 15/808,406

(22) Filed: Nov. 9, 2017

(65) Prior Publication Data

US 2018/0117452 A1 May 3, 2018

Related U.S. Application Data

(63) Continuation of application No. 11/198,218, filed on Aug. 5, 2005, now abandoned, which is a continuation-in-part of application No. 11/042,732, filed on Jan. 24, 2005, now Pat. No. 7,918,723.

(51) Int. Cl.

| | |
|---|---|
| ***A63F 1/00*** | (2006.01) |
| ***A63F 3/00*** | (2006.01) |
| ***G07F 17/32*** | (2006.01) |

(52) U.S. Cl.

CPC ..... *A63F 1/00* (2013.01); *A63F 3/00157* (2013.01); *G07F 17/32* (2013.01); *G07F 17/3288* (2013.01); *A63F 2001/001* (2013.01); *A63F 2001/008* (2013.01)

(58) Field of Classification Search

CPC ..... G07F 17/3288; G07F 17/3293; G07F 17/3211; G07F 17/322; G07F 17/3223; G07F 17/3258; G07F 17/3244; G07F 17/3262; G07F 17/34; A63F 3/00157; A63F 2001/001; A63F 2001/008; A63F 1/00

See application file for complete search history.

(56) References Cited

U.S. PATENT DOCUMENTS

| | | | |
|---|---|---|---|
| 3,708,219 | A | 1/1973 | Forlini et al. |
| 3,810,627 | A | 5/1974 | Levy |
| 3,909,002 | A | 9/1975 | Levy |
| 3,998,309 | A | 12/1976 | Mandas et al. |
| 4,095,795 | A | 6/1978 | Saxton |

(Continued)

FOREIGN PATENT DOCUMENTS

| | | |
|---|---|---|
| CA | 2377577 | 6/2000 |
| EP | 0478412 | 4/1992 |

(Continued)

OTHER PUBLICATIONS

"Scarne's Encyclopedia of Card Games," by John Scarne, 1973, HarperCollins, New York, N.Y., chapter on banking games.

(Continued)

*Primary Examiner* — William H McCulloch, Jr.
(74) *Attorney, Agent, or Firm* — Neal, Gerber & Eisenberg LLP

(57) ABSTRACT

A method and system for playing jackpot and live baccarat games are provided. One feature of the jackpot method involves the use of card combinations that may include, e.g., at least one zero-point card. Another feature of the jackpot method involves initial jackpot contribution from the banker who operates the baccarat game. It is also provided a software program or a set of software program for carrying out any or all the steps of the disclosed gaming method.

10 Claims, 13 Drawing Sheets

(56) References Cited

U.S. PATENT DOCUMENTS 4,333,715 A 6/1982 Brooks
4,337,945 A 7/1982 Levy
4,339,798 A 7/1982 Hedges
4,448,419 A 5/1984 Telnaes
4,467,424 A 8/1984 Hedges
4,517,558 A 5/1985 Davids
4,607,844 A 8/1986 Fullerton
4,621,814 A 11/1986 Stepan et al.
4,659,082 A 4/1987 Greenberg
4,659,182 A 4/1987 Aizawa
4,662,635 A 5/1987 Enokian
4,718,672 A 1/1988 Okada
4,805,907 A 2/1989 Hagiwara
4,856,787 A 8/1989 Itkis
4,858,932 A 8/1989 Keane
4,861,041 A 8/1989 Jones et al.
4,911,449 A 3/1990 Dickinson et al.
4,912,548 A 3/1990 Shanker et al.
4,926,327 A 5/1990 Sidley
4,998,737 A 3/1991 Lamle
5,033,744 A 7/1991 Bridgeman et al.
5,042,818 A 8/1991 Weingardt
5,084,833 A 1/1992 Matsuda et al.
5,086,354 A 2/1992 Bass et al.
5,113,272 A 5/1992 Reamey
5,132,839 A 7/1992 Travis
5,248,142 A 9/1993 Breeding
5,259,613 A * 11/1993 Marnell, II ..... G07F 17/32 273/460
5,265,882 A 11/1993 Malek
5,288,081 A 2/1994 Breeding
5,319,491 A 6/1994 Selbrede
5,325,830 A 7/1994 Hammer
5,342,047 A 8/1994 Heidel et al.
5,362,064 A 11/1994 Lofink et al.
5,364,100 A 11/1994 Ludlow et al.
5,376,587 A 12/1994 Buchmann et al.
5,393,061 A 2/1995 Manship et al.
5,393,067 A 2/1995 Paulsen
5,395,119 A 3/1995 Jacob
5,395,120 A 3/1995 Malek
5,413,351 A 5/1995 Franklin
5,456,465 A 10/1995 Durham
5,467,893 A 11/1995 Landis et al.
5,472,194 A 12/1995 Breeding et al.
5,476,259 A 12/1995 Weingardt
5,490,670 A 2/1996 Hobert
5,494,296 A 2/1996 Grassa
5,539,547 A 7/1996 Ishii et al.
5,544,892 A 8/1996 Breeding
5,564,700 A 10/1996 Celona
5,580,055 A 12/1996 Hagiwara
5,580,310 A 12/1996 Orus et al.
5,585,821 A 12/1996 Ishikura et al.
5,586,937 A 12/1996 Menashe
5,588,650 A 12/1996 Eman et al.
5,589,980 A 12/1996 Bass et al.
5,605,334 A 2/1997 McCrea
5,611,730 A 3/1997 Weiss
5,613,909 A 3/1997 Stelovsky
5,618,232 A 4/1997 Martin
5,639,092 A 6/1997 Macaisa
5,642,698 A 7/1997 Diehl et al.
5,643,086 A 7/1997 Alcorn et al.
5,655,961 A 8/1997 Acres et al.
5,664,998 A 9/1997 Seelig
5,668,174 A 9/1997 Kawagishi
5,669,606 A 9/1997 Brown
5,673,917 A 10/1997 Vancura
5,707,287 A * 1/1998 McCrea, Jr. ..... A63F 1/12 273/292
5,722,890 A 3/1998 Libby et al.
5,735,525 A 4/1998 McCrea
5,743,523 A 4/1998 Kelly et al.
5,743,798 A 4/1998 Adams et al.
5,745,197 A 4/1998 Leung et al.
5,752,881 A 5/1998 Inoue
5,752,882 A 5/1998 Acres et al.
5,759,103 A 6/1998 Freels et al.
5,762,552 A 6/1998 Vuong
5,764,317 A 6/1998 Sadovnik et al.
5,766,076 A 6/1998 Pease et al.
5,770,533 A 6/1998 Franchi
5,772,509 A 6/1998 Weiss
RE35,864 E 7/1998 Weingardt
5,775,993 A 7/1998 Fentz
5,779,546 A 7/1998 Meissner
5,782,692 A 7/1998 Stelovsky
5,788,574 A 8/1998 Ornstein
5,791,992 A 8/1998 Crump et al.
5,795,225 A 8/1998 Jones
5,797,795 A 8/1998 Takemoto et al.
5,800,268 A * 9/1998 Molnick ..... G07F 17/3288 463/12
5,803,451 A 9/1998 Kelly et al.
5,806,854 A 9/1998 Coleman
5,820,459 A 10/1998 Acres et al.
5,820,461 A 10/1998 Pernatozzi
5,830,067 A 11/1998 Graves
5,836,817 A 11/1998 Acres et al.
5,836,818 A 11/1998 Jones
5,839,730 A 11/1998 Pike
5,839,731 A 11/1998 Feola
5,842,698 A 12/1998 Brown
5,851,149 A 12/1998 Xidos et al.
5,873,781 A 2/1999 Keane
5,876,283 A 3/1999 Para et al.
5,879,006 A 3/1999 Bowling
5,879,235 A 3/1999 Kaneko
5,885,085 A 3/1999 Fujita
5,888,136 A 3/1999 Herbert
5,909,876 A 6/1999 Brown
5,910,046 A 6/1999 Wada et al.
5,911,626 A 6/1999 McCrea
5,921,865 A 6/1999 Scagnelli
5,931,471 A 8/1999 Bonito
5,951,397 A 9/1999 Dickinson
5,956,180 A 9/1999 Bass et al.
5,957,459 A 9/1999 Chae
5,961,119 A 10/1999 Brown
5,967,893 A 10/1999 Lawrence et al.
6,001,016 A 12/1999 Walker
6,015,346 A 1/2000 Bennett
6,019,374 A 2/2000 Breeding
6,027,115 A 2/2000 Griswold et al.
6,039,650 A 3/2000 Hill
6,050,895 A 4/2000 Luciano et al.
6,054,969 A 4/2000 Haisma
6,056,641 A 5/2000 Webb
6,059,658 A 5/2000 Mangano et al.
6,080,063 A 6/2000 Khosla
6,083,105 A 7/2000 Ronin et al.
6,093,103 A 7/2000 McCrea
6,113,493 A 9/2000 Walker et al.
6,117,012 A 9/2000 McCrea
6,135,884 A 10/2000 Hedrick et al.
6,142,876 A 11/2000 Cumbers
6,146,270 A 11/2000 Huard
6,149,522 A 11/2000 Alcorn et al.
6,159,095 A 12/2000 Frohm
6,159,098 A 12/2000 Slomiany et al.
6,165,069 A 12/2000 Sines et al.
6,213,875 B1 4/2001 Suzuki
6,217,447 B1 4/2001 Lofink
6,234,482 B1 5/2001 Henderson
6,244,596 B1 6/2001 Kondratjuk
6,251,014 B1 6/2001 Stockdale et al.
6,252,707 B1 6/2001 Kleinberger et al.
6,254,481 B1 7/2001 Jaffe
6,254,484 B1 7/2001 McCrea, Jr.
6,264,561 B1 7/2001 Saffari
6,279,910 B1 8/2001 de Keller
6,293,864 B1 9/2001 Romero
6,312,334 B1 11/2001 Yoseloff

(56) References Cited

U.S. PATENT DOCUMENTS 6,315,666 B1 11/2001 Mastera et al.
6,336,857 B1 1/2002 McBride
6,337,513 B1 1/2002 Clevenger et al.
6,345,824 B1 2/2002 Selitzky
6,346,044 B1 2/2002 Selitzky
6,347,996 B1 2/2002 Gilmore et al.
6,361,437 B1 3/2002 Walker
6,368,216 B1 4/2002 Hedrick et al.
6,375,567 B1 4/2002 Acres
6,375,576 B1 4/2002 Margerie
6,379,244 B1 4/2002 Sagawa et al.
6,394,907 B1 5/2002 Rowe
6,398,220 B1 6/2002 Inoue
6,409,602 B1 6/2002 Wiltshire
6,416,827 B1 7/2002 Chakrapani et al.
6,435,970 B1 8/2002 Baerlocher et al.
6,444,496 B1 9/2002 Edwards et al.
6,445,185 B1 9/2002 Damadian et al.
6,460,848 B1 10/2002 Soltys
6,491,583 B1 12/2002 Gauselmann
6,503,147 B1 1/2003 Stockdale et al.
6,508,709 B1 1/2003 Karmarkar
6,511,072 B1 1/2003 Cruz et al.
6,511,375 B1 1/2003 Kaminkow
6,512,559 B1 1/2003 Hashimoto et al.
6,514,141 B1 2/2003 Kaminkow et al.
6,517,073 B1 2/2003 Vancura
6,517,433 B2 2/2003 Loose et al.
6,517,436 B2 2/2003 Soltys
6,517,437 B1 2/2003 Wells et al.
6,540,230 B1 4/2003 Walker
6,547,664 B2 4/2003 Saunders
6,569,018 B2 5/2003 Jaffe
6,575,541 B1 6/2003 Hedrick et al.
6,575,834 B1 6/2003 Lindo
6,582,301 B2 6/2003 Hill
6,582,302 B2 6/2003 Romero
6,585,591 B1 7/2003 Baerlocher et al.
6,588,758 B1 7/2003 Lee
6,607,195 B2 8/2003 Vancura
6,626,757 B2 9/2003 Oliveras
6,628,244 B1 9/2003 Hirosawa
6,646,695 B1 11/2003 Gauselmann
6,652,378 B2 11/2003 Cannon et al.
6,656,048 B2 12/2003 Olsen
6,659,864 B2 12/2003 McGahn et al.
6,659,866 B2 12/2003 Frost
6,661,425 B1 12/2003 Hiroaki
6,676,517 B2 1/2004 Beavers
6,685,567 B2 2/2004 Cockerille et al.
6,695,703 B1 2/2004 McGahn
6,702,675 B2 3/2004 Poole et al.
6,712,694 B1 3/2004 Nordman
6,712,696 B2 3/2004 Soltys
6,715,756 B2 4/2004 Inoue
6,717,728 B2 4/2004 Putilin
6,719,291 B1 4/2004 de Keller
6,722,979 B2 4/2004 Gilmore et al.
6,726,564 B2 4/2004 Hogan
6,726,565 B2 4/2004 Hughs-Baird
6,755,741 B1 7/2004 Rafaeli
6,758,751 B2 * 7/2004 Soltys ..... G06Q 10/0639 463/29
6,780,105 B1 8/2004 Kaminkow
6,789,801 B2 9/2004 Snow
6,800,026 B2 10/2004 Cannon
6,802,777 B2 10/2004 Seelig et al.
6,804,763 B1 10/2004 Stockdale et al.
6,805,628 B2 10/2004 Romero
6,808,173 B2 10/2004 Snow
6,817,945 B2 11/2004 Seelig et al.
6,817,946 B2 11/2004 Motegi et al.
6,837,494 B2 1/2005 Lee
6,863,608 B1 3/2005 LeMay et al.
6,866,586 B2 3/2005 Oberberger et al.
6,887,157 B2 5/2005 LeMay et al.
6,890,259 B2 5/2005 Breckner et al.
6,896,614 B2 5/2005 Romeo
6,899,625 B2 5/2005 Luciano
6,906,762 B1 6/2005 Witehira et al.
6,916,245 B1 7/2005 Vancura
6,937,298 B2 8/2005 Okada
7,008,319 B2 3/2006 Montgomery et al.
7,029,395 B1 4/2006 Baerlocher
7,070,505 B2 7/2006 Vancura et al.
7,114,724 B2 10/2006 Ritzer
7,128,647 B2 10/2006 Muir
7,189,161 B1 3/2007 Wiltshire
7,198,272 B2 4/2007 Duhamel
7,204,753 B2 4/2007 Ozaki et al.
7,213,812 B2 5/2007 Schubert
7,220,181 B2 5/2007 Okada
7,226,040 B2 6/2007 Keister
7,252,288 B2 8/2007 Seelig et al.
7,255,643 B2 8/2007 Ozaki et al.
7,264,241 B2 9/2007 Schubert
7,303,473 B2 12/2007 Rowe
7,303,475 B2 12/2007 Britt
7,309,065 B2 12/2007 Yoseloff
7,309,284 B2 12/2007 Griswold et al.
7,311,598 B2 12/2007 Kaminkow et al.
7,311,604 B2 12/2007 Kaminkow et al.
7,316,398 B1 1/2008 Pham
7,316,615 B2 1/2008 Soltys
7,322,884 B2 1/2008 Emori et al.
7,325,806 B1 2/2008 Feola
7,326,115 B2 2/2008 Baerlocher
7,329,179 B2 2/2008 Baerlocher
7,329,181 B2 2/2008 Hoshino et al.
7,351,146 B2 4/2008 Kaminkow
7,361,090 B2 4/2008 Lin
7,367,884 B2 5/2008 Breeding
7,387,570 B2 6/2008 Randall
7,404,765 B2 7/2008 Soltys
7,407,438 B2 8/2008 Schubert
7,419,160 B1 9/2008 D'Ambrosio
7,427,236 B2 9/2008 Kaminkow
7,434,805 B2 10/2008 Grauzer
7,448,949 B2 11/2008 Kaminkow et al.
7,451,987 B1 11/2008 Feola
7,452,270 B2 11/2008 Walker et al.
7,465,227 B2 12/2008 Baerlocher
7,470,185 B2 12/2008 Baerlocher
7,488,251 B2 2/2009 Kaminkow
7,503,849 B2 3/2009 Hornik et al.
7,537,456 B2 5/2009 Snow
7,566,274 B2 7/2009 Johnson et al.
7,572,183 B2 8/2009 Olivas
7,575,512 B2 8/2009 Kennedy
7,584,967 B2 9/2009 Webb
7,591,726 B2 9/2009 Baerlocher et al.
7,591,728 B2 9/2009 Gioia
7,614,948 B2 11/2009 Saffari
7,618,319 B2 11/2009 Casey et al.
7,621,533 B2 11/2009 Kenny
7,666,086 B2 2/2010 Baerlocher
7,666,087 B2 2/2010 Hughs-Baird
7,666,092 B2 2/2010 Kaminkow et al.
7,699,698 B2 4/2010 Randall
7,731,586 B2 6/2010 Letovsky
7,735,657 B2 6/2010 Johnson
7,753,798 B2 7/2010 Soltys
7,758,419 B2 7/2010 Rowe et al.
7,762,889 B2 7/2010 Shijeta
7,769,232 B2 8/2010 Downs
7,771,270 B2 8/2010 Kaminkow et al.
7,775,524 B2 8/2010 Lutnick et al.
7,775,868 B2 8/2010 Toyoda
7,780,515 B2 8/2010 Okada
7,789,743 B2 9/2010 Walker et al.
7,819,744 B2 10/2010 Hughs-Baird
7,822,641 B2 10/2010 Abbott et al.
7,828,643 B2 11/2010 Baerlocher
7,837,547 B2 11/2010 Cannon

(56) References Cited

U.S. PATENT DOCUMENTS 7,846,018 B2 12/2010 Baerlocher
7,867,077 B2 1/2011 Baerlocher et al.
7,871,324 B2 1/2011 Kaminkow
7,878,892 B2 2/2011 Sines et al.
7,896,734 B2 3/2011 Kaminkow et al.
7,905,771 B2 3/2011 Walker et al.
7,905,774 B2 3/2011 Walker et al.
7,909,688 B2 3/2011 Yoshizawa
7,914,368 B2 3/2011 Chun
7,914,372 B2 3/2011 Tessmer et al.
7,918,723 B2 * 4/2011 Chun ..... A63F 3/00157 273/149 R
7,922,587 B2 4/2011 Chun
7,931,531 B2 4/2011 Oberberger
7,950,993 B2 5/2011 Oberberger
7,963,845 B2 6/2011 Baerlocher
7,967,674 B2 6/2011 Baerlocher
7,976,378 B2 7/2011 Baerlocher
7,980,948 B2 7/2011 Rowe et al.
8,002,281 B2 8/2011 Kearns, Sr.
8,020,866 B2 9/2011 Walker et al.
8,057,308 B2 11/2011 Kaminkow et al.
8,066,564 B2 11/2011 Randall
8,087,984 B2 1/2012 Okujyo
8,087,985 B2 1/2012 Katz
8,087,999 B2 1/2012 Oberberger et al.
8,109,821 B2 2/2012 Kovacs
8,123,618 B2 2/2012 Karmarkar
8,128,491 B2 3/2012 Vasquez et al.
8,128,492 B2 3/2012 Vasquez et al.
8,152,617 B2 4/2012 Katz
8,152,624 B2 4/2012 Gerrard et al.
8,152,629 B2 4/2012 DeWaal et al.
8,162,666 B2 4/2012 Parham
8,167,711 B2 5/2012 Baerlocher
8,172,660 B2 5/2012 Lancaster et al.
8,177,627 B2 5/2012 Baerlocher
8,182,321 B2 5/2012 Chun
8,182,323 B2 5/2012 Okada
8,197,335 B2 6/2012 DeWaal et al.
8,202,153 B2 6/2012 Baerlocher
8,206,212 B2 6/2012 Iddings et al.
8,210,920 B2 7/2012 Chun
8,231,456 B2 7/2012 Zielinski
8,235,801 B2 8/2012 Tan
8,246,472 B2 8/2012 Kaminkow et al.
8,267,765 B2 9/2012 Baerlocher
8,305,550 B2 11/2012 Jung et al.
8,308,559 B2 11/2012 Chun
8,313,373 B2 11/2012 Walker et al.
8,317,589 B2 11/2012 Tessmer et al.
8,323,105 B2 12/2012 Chun
8,342,954 B2 1/2013 Oberberger et al.
8,360,852 B2 1/2013 Randall
8,360,859 B2 1/2013 Walker et al.
8,403,740 B2 3/2013 Kovacs et al.
8,419,549 B2 4/2013 Kaminkow et al.
8,425,305 B2 4/2013 Baerlocher et al.
8,430,735 B2 4/2013 Oberberger
8,430,739 B2 4/2013 Rodgers
8,454,427 B2 6/2013 Baerlocher
8,460,095 B2 6/2013 Tan
8,474,820 B2 7/2013 Walker et al.
8,485,888 B2 7/2013 Baerlocher
8,496,521 B2 7/2013 Randall
8,500,533 B2 8/2013 Lutnick et al.
8,506,380 B2 8/2013 Hughes et al.
8,517,824 B2 8/2013 Zielinski et al.
8,613,650 B2 12/2013 Kovacs et al.
9,135,775 B2 9/2015 Pececnik
9,214,056 B2 12/2015 Kovacs et al.
9,230,398 B2 * 1/2016 Chun ..... G07F 17/3225
9,349,250 B2 5/2016 Kaminkow et al.
2001/0000118 A1 4/2001 Sines et al.
2001/0013681 A1 8/2001 Bruzzese et al.
2001/0029200 A1 10/2001 Romero
2002/0002070 A1 1/2002 Romero
2002/0002073 A1 1/2002 Montgomery
2002/0015489 A1 2/2002 Ben-David
2002/0036380 A1 3/2002 Perrie
2002/0045472 A1 4/2002 Adams
2002/0068635 A1 6/2002 Hill
2002/0072407 A1 6/2002 Soltys
2002/0077170 A1 6/2002 Johnson
2002/0077712 A1 6/2002 Safaei et al.
2002/0090988 A1 7/2002 Frost et al.
2002/0094869 A1 7/2002 Harkham
2002/0111205 A1 8/2002 Beavers
2002/0115489 A1 8/2002 Jordan
2002/0147042 A1 10/2002 Vuong
2002/0147047 A1 10/2002 Letovsky et al.
2002/0173354 A1 11/2002 Winans et al.
2003/0003997 A1 1/2003 Vuong
2003/0013510 A1 1/2003 Vuong et al.
2003/0027624 A1 2/2003 Gilmore et al.
2003/0032478 A1 2/2003 Takahama et al.
2003/0032479 A1 2/2003 LeMay et al.
2003/0050107 A1 3/2003 Moody
2003/0060271 A1 3/2003 Gilmore et al.
2003/0064781 A1 4/2003 Muir
2003/0067112 A1 4/2003 Grauzer
2003/0069071 A1 4/2003 Britt
2003/0073497 A1 4/2003 Nelson
2003/0087690 A1 5/2003 Loose et al.
2003/0104854 A1 6/2003 Cannon
2003/0130028 A1 7/2003 Aida et al.
2003/0151199 A1 8/2003 Lee
2003/0151201 A1 8/2003 Lee
2003/0176214 A1 9/2003 Burak et al.
2003/0181231 A1 9/2003 Vancura
2003/0199306 A1 10/2003 Parker
2003/0199308 A1 10/2003 Parker
2003/0203756 A1 10/2003 Jackson
2003/0224854 A1 12/2003 Joao
2003/0232651 A1 12/2003 Huard
2003/0234489 A1 12/2003 Okada
2003/0236114 A1 12/2003 Griswold et al.
2003/0236118 A1 12/2003 Okada
2004/0002379 A1 1/2004 Parrott et al.
2004/0023712 A1 2/2004 Oliver
2004/0023714 A1 2/2004 Asdale
2004/0023722 A1 2/2004 Vuong
2004/0029636 A1 2/2004 Wells
2004/0063490 A1 4/2004 Okada
2004/0066475 A1 4/2004 Searle
2004/0070146 A1 4/2004 Snow
2004/0077425 A1 4/2004 Goossens
2004/0082372 A1 4/2004 Romero
2004/0084843 A1 5/2004 Snow
2004/0087357 A1 5/2004 Johnson
2004/0090003 A1 5/2004 Snow
2004/0090005 A1 5/2004 Snow
2004/0108656 A1 6/2004 Snow
2004/0116177 A1 6/2004 Frost
2004/0116178 A1 6/2004 Okada
2004/0116179 A1 6/2004 Nicely
2004/0145116 A1 7/2004 Calvo et al.
2004/0147303 A1 7/2004 Imura et al.
2004/0147314 A1 7/2004 LeMay et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183972 A1 9/2004 Bell
2004/0192430 A1 9/2004 Burak et al.
2004/0198485 A1 10/2004 Loose et al.
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0214635 A1 10/2004 Okada

(56) References Cited

U.S. PATENT DOCUMENTS

2004/0214637 A1 10/2004 Nonaka
2004/0224747 A1 11/2004 Okada
2004/0224777 A1 11/2004 Smith
2004/0233663 A1 11/2004 Emslie et al.
2004/0235542 A1 11/2004 Stronach
2004/0239582 A1 12/2004 Seymour
2005/0003886 A1 1/2005 Englman
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0062227 A1 3/2005 Grauzer et al.
2005/0062410 A1 3/2005 Bell et al.
2005/0063055 A1 3/2005 Engel
2005/0073102 A1 4/2005 Yoseloff et al.
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0176493 A1 8/2005 Nozaki et al.
2005/0176507 A1 8/2005 Ephrati et al.
2005/0192090 A1 9/2005 Muir et al.
2005/0192099 A1 9/2005 Nguyen et al.
2005/0206582 A1 9/2005 Bell et al.
2005/0208994 A1 9/2005 Berman
2005/0218597 A1 10/2005 Parsadaian
2005/0233794 A1 10/2005 Cannon
2005/0233799 A1 10/2005 LeMay et al.
2005/0233803 A1 10/2005 Yang
2005/0239539 A1 10/2005 Inamura
2005/0266912 A1 12/2005 Sekiguchi
2005/0282618 A1 12/2005 OHalloran
2005/0282625 A1 12/2005 Nicely
2005/0285337 A1 12/2005 Durham et al.
2006/0009283 A1 1/2006 Englman
2006/0030399 A1 2/2006 Baerlocher
2006/0033267 A1 2/2006 Wong
2006/0040733 A1 2/2006 Baerlocher
2006/0052168 A1 3/2006 Shacham
2006/0063577 A1 3/2006 Downs
2006/0071429 A1 4/2006 Okujyo et al.
2006/0073882 A1 4/2006 Rozkin et al.
2006/0084502 A1* 4/2006 Downs, III ..... G07F 17/32 463/29
2006/0092170 A1 5/2006 Bathiche et al.
2006/0100014 A1 5/2006 Griswold et al.
2006/0103071 A1 5/2006 Ritzer
2006/0103951 A1 5/2006 Bell et al.
2006/0125745 A1 6/2006 Evanicky
2006/0128472 A1 6/2006 Beavers
2006/0135240 A1 6/2006 Barshack
2006/0135243 A1 6/2006 Englman
2006/0148547 A1 7/2006 Montgomery
2006/0166726 A1* 7/2006 Chun ..... A63F 1/00 463/12
2006/0166727 A1 7/2006 Burak
2006/0166731 A1 7/2006 Yoshimi
2006/0178181 A1* 8/2006 Chun ..... A63F 3/00157 463/12
2006/0189382 A1 8/2006 Muir et al.
2006/0191177 A1 8/2006 Engel
2006/0226605 A1 10/2006 Kenny
2006/0258446 A1 11/2006 Nguyen et al.
2006/0284376 A1* 12/2006 Snow ..... A63F 3/00157 273/292
2006/0284574 A1 12/2006 Emslie et al.
2006/0287042 A1 12/2006 Osawa
2006/0287058 A1 12/2006 Resnick
2006/0290594 A1 12/2006 Engel et al.
2007/0004510 A1 1/2007 Underdahl et al.
2007/0010315 A1 1/2007 Hein
2007/0013127 A1 1/2007 Ellis
2007/0018406 A1 1/2007 Kennedy
2007/0021198 A1 1/2007 Muir et al.
2007/0026922 A1 2/2007 Lindo
2007/0026947 A1 2/2007 Chun
2007/0032283 A1 2/2007 Chun
2007/0060259 A1 3/2007 Pececnik
2007/0123341 A1 5/2007 Tessmer et al.
2007/0129123 A1 6/2007 Eryou et al.
2007/0135204 A1 6/2007 Nicely
2007/0155512 A1 7/2007 Wells
2007/0218968 A1 9/2007 Snow
2007/0243927 A1 10/2007 Soltys
2007/0243929 A1 10/2007 Skotarczak
2007/0243935 A1 10/2007 Huizinga
2008/0001358 A1 1/2008 Scott
2008/0009334 A1 1/2008 Walker
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0026807 A1 1/2008 Moshal
2008/0045288 A1 2/2008 Moshal
2008/0064467 A1 3/2008 Reiner
2008/0076499 A1 3/2008 Lowery
2008/0085769 A1 4/2008 Lutnick
2008/0108400 A1 5/2008 Chun
2008/0113778 A1 5/2008 Chun
2008/0113783 A1 5/2008 Czyzewski
2008/0146311 A1 6/2008 Walker
2008/0146344 A1 6/2008 Rowe et al.
2008/0149705 A1 6/2008 Giobbi et al.
2008/0182650 A1 7/2008 Randall et al.
2008/0194334 A1 8/2008 Kuok
2008/0214274 A1 9/2008 Thomas
2008/0230993 A1 9/2008 Chun
2008/0231611 A1 9/2008 Bathiche et al.
2008/0248865 A1 10/2008 Tedesco et al.
2008/0254881 A1 10/2008 Lutnick
2008/0280667 A1 11/2008 Chun
2008/0280668 A1 11/2008 Chun
2008/0305855 A1 12/2008 Czyewski
2008/0318668 A1 12/2008 Ching et al.
2009/0029755 A1 1/2009 Chun
2009/0029766 A1 1/2009 Lutnick et al.
2009/0061974 A1 3/2009 Lutnick et al.
2009/0069079 A1 3/2009 Britt et al.
2009/0111573 A1 4/2009 Iddings
2009/0115133 A1 5/2009 Kelly et al.
2009/0124323 A1 5/2009 Dunn
2009/0124385 A1 5/2009 Cuddy
2009/0137313 A1 5/2009 Young
2009/0176547 A1 7/2009 Katz
2009/0203433 A1 8/2009 Olivas
2009/0221360 A1 9/2009 Wooding
2009/0252546 A1 10/2009 Kaleta
2010/0056262 A1 3/2010 Englman
2010/0102511 A1 4/2010 Tammesoo
2010/0105457 A1 4/2010 Miller
2010/0105459 A1 4/2010 Miller
2010/0111820 A1 5/2010 Natura et al.
2010/0113119 A1 5/2010 Miller
2010/0117299 A1 5/2010 Nicely
2010/0120506 A1 5/2010 Davis et al.
2010/0130280 A1 5/2010 Arezina et al.
2010/0222133 A1 9/2010 Spencer
2010/0234086 A1 9/2010 Michaelson
2010/0255897 A1 10/2010 Pececnik
2010/0295247 A1 11/2010 Laduca
2011/0031694 A1 2/2011 Cohen
2011/0039612 A1 2/2011 Pececnik
2011/0059800 A1 3/2011 Anderson
2011/0105207 A1 5/2011 Chun
2011/0111824 A1 5/2011 Cuddy et al.
2011/0120506 A1 5/2011 Sakai
2011/0140362 A1 6/2011 Chun
2011/0159965 A1 6/2011 Chun
2012/0064958 A1 3/2012 Lisandro
2012/0270625 A1 10/2012 Chun
2012/0276973 A1 11/2012 Kishi
2012/0289300 A1 11/2012 Chun
2013/0165201 A1 6/2013 Chun
2013/0184044 A1 7/2013 Frost

(56) References Cited

U.S. PATENT DOCUMENTS

| | | | | |
|---|---|---|---|---|
| 2013/0190075 | A1 | 7/2013 | Chun | |
| 2013/0288764 | A1 | 10/2013 | Chun | |
| 2013/0288779 | A1 | 10/2013 | Chun | |
| 2014/0135088 | A1 | 5/2014 | Chun | |
| 2018/0117452 | A1* | 5/2018 | Chun | A63F 1/00 |

FOREIGN PATENT DOCUMENTS

| | | | |
|---|---|---|---|
| EP | 110513 | | 5/2001 |
| EP | 467329 | | 10/2004 |
| EP | 1892683 | | 2/2008 |
| GB | 2408696 | | 6/2005 |
| GB | 2403429 | | 7/2006 |
| GB | 2430385 | | 3/2007 |
| JP | H0956889 | A | 3/1997 |
| JP | 2006181270 | A | 7/2006 |
| WO | 99/19027 | | 4/1999 |
| WO | 99/42889 | | 8/1999 |
| WO | 99/44095 | | 9/1999 |
| WO | 0079467 | | 12/2000 |
| WO | 01/09664 | | 2/2001 |
| WO | 01/15127 | | 3/2001 |
| WO | 01/15128 | | 3/2001 |
| WO | 01/15132 | | 3/2001 |
| WO | 02/17841 | | 3/2002 |
| WO | 2004/001486 | | 12/2003 |
| WO | 2004/102520 | | 11/2004 |
| WO | 2005/056134 | | 6/2005 |
| WO | 2005/065793 | | 7/2005 |
| WO | 2006/034192 | | 3/2006 |
| WO | 2006/038819 | | 4/2006 |
| WO | 2007/016035 | | 2/2007 |
| WO | 2007/032945 | | 3/2007 |
| WO | 2007/073534 | | 6/2007 |
| WO | 2007/099334 | | 9/2007 |
| WO | 2008/026950 | | 3/2008 |
| WO | 2008/092385 | | 8/2008 |
| WO | 2009/107131 | | 9/2009 |

OTHER PUBLICATIONS

"Scarne's Complete Guide to Gambling," by John Scarne, 1961, Simon & Schuster, New York, N.Y., chapter on roulette.

Macau Patent Application Notice of Allowance, Macau Patent Application 1/150.

"Sic bo". Wikipedia, the free encyclopedia. First accessed Feb. 12, 2013. Current version Feb. 14, 2013. <http://en.wikipedia.org/wiki/Sic_bo>.

International Search Report for PCT/CA2006/002069, dated Mar. 20, 2007, 16 pgs.

*EZ Baccarat*, DP Stud, Inc., www.ezbaccarat.com, 2 pgs. (2003).

International Search Report for PCT/CA2006/001295, dated Nov. 2, 2006, 16 pgs.

Parlett, David, "A History of Poker," copyright 2005. Accessed Aug. 23, 2013. 13pp. <http://www.pagat.com/poker/history.html>.

* cited by examiner

METHODS AND SYSTEMS FOR PLAYING BACCARAT JACKPOT

PRIORITY CLAIM

This application is a continuation of, claims priority to and the benefit of U.S. patent application Ser. No. 11/198,218, filed on Aug. 5, 2005, which is a continuation-in-part of, claims priority to and the benefit of U.S. patent application Ser. No. 11/042,732, filed on Jan. 24, 2005, now U.S. Pat. No. 7,918,723, the entire contents of each of which are incorporated by reference.

BACKGROUND OF THE INVENTION

The present invention is generally directed to a method of play and apparatus for playing a live baccarat game. In particular, the present invention relates to a method for playing a live baccarat game and playing jackpot.

Baccarat is one of the more popular gambling games played in casinos or gaming establishments. As is well known, the game is played on an elongated table having a game board displayed along the upper surface of the table. The game board displays certain wagering areas, and the elongated table allows for the seating of multiple players or bettors (1-16) and the positioning of the multiple dealers (3) necessary for operating the casino game. Bettor locations are typically numbered on the table and each bettor location has an area designated for a wager on the bank hand and an area designated for a wager on the player hand. Baccarat uses a standard deck of 52 playing cards and is usually dealt from a shoe having multiple decks that have been shuffled together prior to the beginning of play.

A feature of conventional baccarat games is that they have relatively simple rules. However, the simplicity of the rules has led to a corresponding simplicity in the relatively few types of wagers which may be placed during the play of the game, which may limit interest on the part of the player(s) and thus further limit the casino in terms of profit and payout.

The embodiments described below address the above-described issues and needs.

SUMMARY OF THE INVENTION

Provided herein are methods and systems therefore for playing a modified live baccarat game. The methods allow the wagering on the live baccarat games according to conventional rules. In addition, the methods provided herein allow betting on a site bet or wager for jackpot. In some embodiments, outcomes of the jackpot betting can be determined by combinations of cards that involve at least one zero-point card, described below. In some other embodiments, outcomes of the jackpot betting can be determined by specific combinations of cards defined below. The present invention also provides a jackpot gaming method that allows the banker to make initial contributions for the jackpot game.

The method for playing live baccarat described herein includes the following steps:

- dealing cards to a player hand and a bank hand according to a set of conventional baccarat rules,
- allowing at least a first player to place a bet on live baccarat,
- allowing at least a second player to place a bet on jackpot where the second player can be the same as or different from the first player,

- determining the outcome of the live baccarat game according to the set of conventional baccarat rules, and
- determining the outcome of the jackpot according to a combination of cards defined herein.

The present invention also discloses a software program or a set of software programs for carrying out any or all steps of the betting method described herein. The live baccarat game can also be incorporated into an electronic device or an entertainment gaming machine.

DETAILED DESCRIPTION

Figure 1:
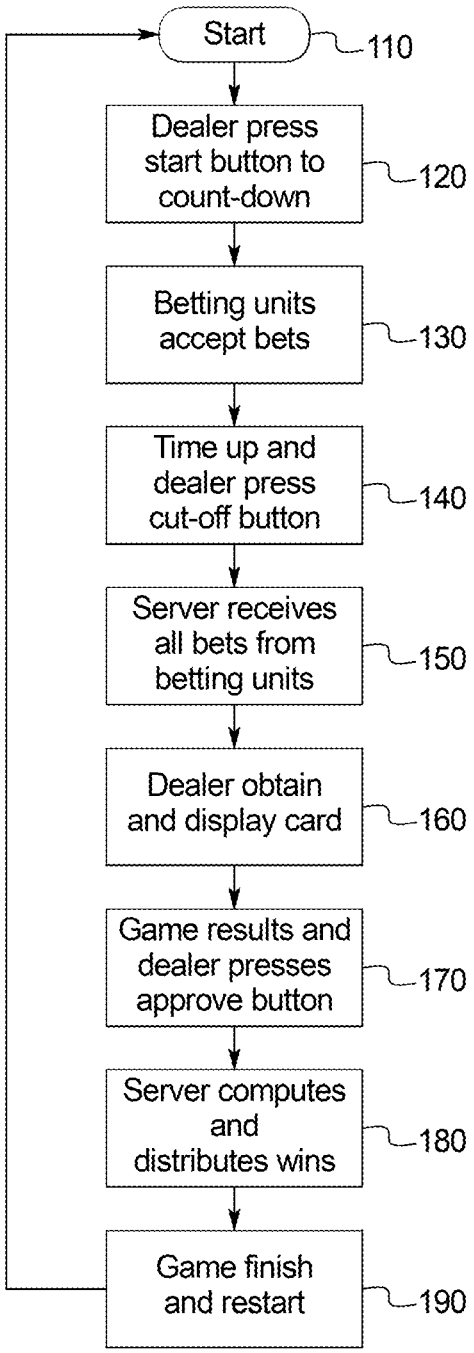
FIG. 1 is a flow chart disclosing the incorporation of the present betting methods in the game of baccarat.

Provided herein are methods and systems therefore for playing a modified live baccarat game. The methods allow the wagering on the live baccarat games according to conventional rules. In addition, the methods provided herein allow betting on a site bet or wager for jackpot. The present invention also provides a jackpot gaming method that allows the banker to make initial contributions for the jackpot game. As used herein, a zero-point card refers to any of the 10, J, Q, or K, and the banker refers to one who owns or operates the live baccarat establishment.

In general, the method for playing live baccarat described herein includes the following steps:

- dealing cards to a player hand and a bank hand according to a set of conventional baccarat rules,
- allowing at least a first player to place a bet on live baccarat,
- allowing at least a second player to place a bet on jackpot where the second player can be the same as or different from the first player,
- determining the outcome of the live baccarat game according to the set of conventional baccarat rules, and
- determining the outcome of the jackpot according to a combination of cards defined below.

The present invention also provides a software program or a set of software programs for carrying out any or all steps of the betting method described herein. The baccarat game can also be incorporated into an electronic device or an entertainment gaming machine. Representative electronic devices include, but are not limited to, laptop computers or desktop computers.

Live Baccarat Game

The object of baccarat is for the bettor to successfully wager on whether the bank's hand or the player's hand is going to win. The bettor receives even money for his wager if he selects the winning hand and loses his wager if he selects the losing hand. Because of the rules of play of baccarat, the bank's hand has a slightly higher chance of winning than does the player's hand. Therefore, if the bettor wagers on the bank's hand, the bettor is required to pay to the gaming establishment a commission (typically 5%) of the amount the bettor wins. No commission is paid if the bettor successfully wagers on the player's hand.

The term "wager", as used herein, can be used interchangeably with the term "bet." The term "wagering" is used interchangeably with the term "betting."

Conventional methods of playing baccarat are described as follows:

A multiple number of decks of standard playing cards, 52 in number, are used; typically six to twelve decks are shuffled together and placed in a shoe from which the cards are dealt during the play of the game.

Each bettor makes a wager on whether the bank's hand or the player's hand will win. After all wagers are made, two cards are dealt from the shoe to the bank position and two cards are dealt from the shoe to the player's position on the table layout. The cards are turned face up and the value of the bank hand and the player hand is determined.

Aces count as one; kings, queens, jacks and tens count as zero and the other cards count as their respective face value. The suits (hearts, diamonds, spades and clubs) have no meaning in baccarat. The highest hand value in baccarat is nine. All hand values range from a low of zero to a high of nine. If when the cards are added together, the total of the hand exceeds nine, then the hand value is determined by subtracting ten from the total of the hand. For example, a seven and nine total sixteen, but the hand value is six. An Ace and a nine total ten, but the hand value is zero.

A two card total of eight or nine is called a "natural"; a two card total of zero is called a "baccarat". As will be explained hereafter, in certain situations in the play of the game, a third card will be dealt. The value of this third card is added to the total of the first two cards and a new hand value is established. Again, if the new hand total exceeds nine, the hand value is determined by subtracting ten from the total of the hand. Wagering locations are provided on the baccarat table layout. Whichever of the bank hand or the player hand is closest to a total of nine is the winner.

The way of betting may differ in different gaming establishments. In the U.S., for example, prior to the deal, each bettor can make one of three wagers: 1) that the bank hand will win, 2) that the player hand will win, or 3) that the bank hand and the player hand will tie. In Macau, for example, one can make one of five wagers: 1) that the bank hand will win, 2) that the player hand will win, 3) that the bank hand and the player hand will tie, 4) that the first two cards in the bank hand are of the same kind, regardless of the type of suit, forming a Bank Pair, or (5) that the first two cards in the player hand are of the same kind, regardless of the type of suit, forming a Player Pair.

All winning bank hand wagers in scenario 1) in both the U.S. and Macau are paid off at odds of one-to-one and the house charges a five percent (5%) commission on the amount won by the bettor. For example, if a bettor wagers $100 on the bank hand and the bank hand wins, the bettor wins $100 and is charged a $5 commission on the amount that the bettor won. The bettor is not charged any commission on the amount of his wager.

All wagers that select winning player hand in scenario 2) in both the U.S. and Macau are paid off at odds of one-to-one and the bettor is not charged any commission on the amount of his winnings or his wager.

All winning wagers on the tie in scenario 3) in both the U.S. and Macau can be paid off at odds of eight-to-one (depending on the gaming establishment) and the bettor is not charged any commission on the amount of his winnings or his wager. If a tie hand occurs, all wagers on the bank hand and all wagers on the player hand are "pushes" and the amount wagered is returned to the bettor.

All winning wagers on the Bank Pair bet in scenario 4) in Macau can be paid off at odds of eleven-to-one (depending on the gaming establishment) and the bettor is not charged any commission on the amount of his winnings or his wager.

All winning wagers on the Player Pair bet in scenario 5) in Macau can be paid off at odds of eight-to-one (depending on the gaming establishment) and the bettor is not charged any commission on the amount of his winnings or his wager.

The play of baccarat typically uses three casino dealers to operate the game. The casino dealers jointly participate in the shuffling of the decks of cards. After the shuffle is completed, one of the players is typically asked to cut the decks using a plastic cut card. The dealer then separates and restacks the cards from the point of the cut and the dealer or a player then inserts the plastic cut card no less than fifteen cards (in Las Vegas, U.S.) or no less than twelve cards (in Macau) from the ends of the stacked decks and the entire stacked decks are placed into a shoe from which the cards are dealt during the play of the game. When the inserted plastic cut card appears during play, the hand in progress is completed and that round of play then ends. The cards are reshuffled to prepare for the next round of baccarat.

In conventional baccarat, the bettors deal the cards used in the game. Initially, one of the casino dealers (called the "caller") passes the shoe to the bettor sitting in seat number "1" at the baccarat table. After all wagers have been made, the caller tells the bettor with the shoe to begin the deal. The bettor deals a first card to the caller, a first card to himself, a second card to the caller and a second card to himself. All cards are dealt face down. The two cards given to the caller represent the player hand and the two cards kept by the bettor who is dealing the cards represent the bank hand.

The caller than allows one of the other bettors to turn up the player's hand. Traditionally, this honor is given to the bettor who has made the largest wager. The bettor turns up the two cards of the player's hand and tosses them to the caller. The caller places these two cards face up in the table location designated for the "player hand" and the caller announces the point total of the player hand.

The bettor who has the shoe then turns over the cards of the bank hand and tosses these two cards to the caller. The caller places these two cards face up in the table location designated for the "bank hand" and the caller announces to point total of the bank hand. Depending on the point total of the player's hand and the bank's hand, one more card may be dealt to either the player's hand, the bank's hand, or both. The rules for determining whether a third card is dealt are fixed rules, there is no discretion for either the player's hand or the bank's hand on whether a third card is dealt.

If either the player hand or the bank hand has a point total of eight or nine on the first two cards, no third card is dealt to either hand and the hand with the highest point total is the winner (or the hand is a tie, as the case may be). If neither the player hand or the bank hand has a point total of eight or nine, then there is a possibility of a third card draw.

The third card draw rules are as follows:

Rule #1: If the initial two card player hand has a point total of 0, 1, 2, 3, 4 or 5, draws a third card. If the initial two card player hand has a point total of 6 or 7, the player hand stands and does not receive a third card.

Rule #2: If the player hand stands and does not draw a third card, then the bank hand follows Rule #1. In other words, if the player hand has a point total of 6 or 7, the bank hand draws a third card on a point total of 0, 1, 2, 3, 4 or 5 and the bank hand stands on a point total of 6 or 7.

Rule #3: If the player hand draws a third card, the bank hand must draw or stand as described in Table 1.

TABLE 1

| Bank hand two card point total | Bank hand draws when the player's hand third card is: | Bank hand stands when the player's hand third card is: |
|---|---|---|
| 0, 1 or 2 | Bank always draws | — |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | — | Bank always stands |

All third card draw determinations are automatically made by the caller who is skilled in the game of baccarat. When the rules of baccarat require a third card for the player hand, the caller will request a card for the player hand. After the player hand is completed, the bank hand is completed in the same fashion. The caller then declares which hand has the highest point total and declares that hand the winner (or the caller declares a tie hand as the case may be).

In conventional baccarat the bettor who acts as the dealer continues to deal the cards until the player hand wins. As soon as the player hand wins, it is customary to pass the shoe counterclockwise around the baccarat table to the next bettor so that each bettor has the opportunity to deal the cards. Any bettor may decline to deal the cards. The fact that one of the bettors is physically dealing the cards has no affect on the outcome of the game because the rules for drawing and standing do not allow any discretion on the part of the players.

The players can play the game according to conventional baccarat rules, which may vary from place to place. In one embodiment, the baccarat game is played according to the U.S. rules as used in Las Vegas. In another embodiment, the baccarat game is played according to the baccarat rules promulgated by the government of Macau Special Administration Region.

In some embodiments, there is a maximum limit on the total bet can be made through a single betting terminal for the live baccarat game. In one embodiment, the maximum bet can be made through one terminal for live baccarat is, for example, HK$20,000.

Jackpot

The method and system described herein provide a method for jackpot betting, Paradise Jackpot™. The players of the live baccarat game can make a separate bet for jackpot. The jackpot bet can be placed with a bet for live baccarat or without a bet for the same live baccarat.

In some embodiments, the outcome of the jackpot betting is determined by the combination of cards that includes zero-point cards. The combination includes at least one zero-point cards, which are 10, J, Q and K. In one embodiment, the rules for playing Paradise Jackpot™ are described below:

(1) The gaming system provides a jackpot. Players who wish to bet on the Paradise Jackpot™ can place a separate bet, e.g. HKD 20 per game in minimum, which will be referred to as bet unit. The maximum number of bet units will not be restricted.

(2) Players can bet in Paradise Jackpot™ without placing bet in the same live baccarat game. Each player can place more than one bet unit in one game. When the Paradise Jackpot™ is won, the payout for each bet unit will be equal to the money in the Paradise Jackpot™ pool divided by the total number of bet unit.

(3) If the first 5 cards drawn in one baccarat game resulting in A, K, Q, J, 10 in spade, regardless of the sequence, then 100% of the Paradise Jackpot™ is won.

(4) If the first 5 cards drawn in one baccarat game resulting in K, Q, J, 10 in spade and A in either heart, club or diamond, regardless of the sequence, then 10% of the Paradise Jackpot™ is won.

In some other embodiments, the Paradise Jackpot™ can be played according to Rules (I)-(III), defined below:

(I) The Paradise Jackpot™ is won if any of the following is met:

1) any five cards forming a sequence, regardless of the order they are drawn, e.g., A,2,3,4,5 or 9,10,J,Q,K;
2) five cards of a kind, e.g. A,A,A,A,A or K,K,K,K,K;
3) four cards of a kind, regardless of the order they are drawn, e.g., K,K,K,K,2 or 2,K,K,K,K;
4) three cards of a kind plus a pair, regardless of the order they are drawn, e.g., 10,10,10,2,2;
5) three cards of a kind, regardless of the order they are drawn, e.g., 2,2,2,10,J
6) two pairs, regardless of the order they are drawn, e.g., Q,Q,2,K,K;
7) all the 5 cards of the same symbols (same suit): spade, heart, club or diamond, e.g., A(spade),10 (spade),J(spade),K(spade),Q(spade); or
8) any specific combination of five cards as specified from time to time.

(II) The Paradise Jackpot™ is won by any specific combination of the first four, three or two cards drawn in a live baccarat game, with regard to/regardless of the drawn sequence. Specifically, the Paradise Jackpot™ is won if any of the following is met:

(A) if the first four cards that are drawn form a combination as defined below:

1) the first four cards forming a sequence, with regard to/regardless of the order they are drawn, e.g., A,2,3,4, or 10,J,Q,K;
2) the first four cards of a kind, e.g. A,A,A,A or J,J,J,J;
3) three cards of a kind, with regard to/regardless of the order they are drawn, e.g., K,K,K,2 or 10,10, 10,2;
4) two cards of a kind plus a pair, with regard to/regardless of the order they are drawn, e.g., 2,2,J,J, which is a two pair sequence;
5) two cards of a kind, with regard to/regardless of the order they are drawn, e.g., 10,10,Q,Q;

6) all the four cards of the same symbols (same suit): spade, heart, club or diamond, e.g., A(spade),10 (spade),J(spade), K(spade); or 7) any specific combination of the first four cards as specified from time to time, (B) if the first three cards that are drawn form a combination as defined below:

1) the first three cards forming a sequence, with regard to/regardless of the order they are drawn, e.g., A,2,3, or 10,J,K;

2) the first three cards of a kind, e.g. A,A,A or 2,2,2;

3) two cards of a kind, with regard to/regardless of the order they are drawn, e.g., K,K,2 or 10,10,2;

4) two cards forming a pair, with regard to/regardless of the order they are drawn, e.g., 2,J,J or J,J,2;

5) all the three cards of the same symbols (same suit): spade, heart, club or diamond, e.g., A(spade),J(spade),K(spade); or 6) any other specific combination of the first four cards as specified from time to time, or (C) if the first two cards that are drawn form a combination as defined below:

1) the first two cards forming a sequence, with regard to/regardless of the order they are drawn, e.g., A,2, or J,Q;

2) the first two cards of a kind, e.g. A,A or 10,10, which is also a pair;

3) the first two cards of the same symbols (same suit): spade, heart, club or diamond, e.g., A(spade),10(spade); or 4) any other specific combination of the first four cards as specified from time to time.

(III) The Paradise Jackpot™ is won by any specific combination of the last six, five, four, three, and two cards drawn in a live baccarat game, with regard to/regardless of the drawn sequence. Specifically, the Paradise Jackpot™ is won if any of the following is met:

(A) if the last six cards that are drawn form a combination as defined below:

1) the last six cards forming a sequence, with regard to/regardless of the drawn sequence they are drawn, e.g., A,2,3,4,5,6 or 8,9,10,J,Q,K;

2) six cards of a kind, e.g. A,A,A,A,A,A or 2,2,2,2,2,2;

3) five cards of a kind, with regard to/regardless of the order they are drawn, e.g., K,K,K,K,K,2 or 2,10,10,0,10,10,10;

4) four cards of a kind, with regard to/regardless of the order they are drawn, e.g., K,K,K,K,2,10 or 2,A,J,J,J,J;

5) four cards of a kind plus a pair, with regard to/regardless of the order they are drawn, e.g., K,K,K,K,2,2 or 2,2,J,J,J,J;

6) three cards of a kind plus a pair, with regard to/regardless of the order they are drawn, e.g., 2,2,2,J,J,A or J,J,2,2,2,K;

7) three cards of a kind, with regard to/regardless of the order they are drawn, e.g., A,A,A,10,J,K or 10,J,K,2,2,2;

8) three pairs, with regard to/regardless of the order they are drawn, e.g., Q,Q,K,K,J,J or 2,2,10,10,K,K;

9) all the six cards of the same symbols (same suit): spade, heart, club or diamond, e.g., A(spade),10 (spade),J(spade),K(spade),Q(spade),2(spade); or 10) any other specific combination of six cards as specified from time to time.

(B) if the last five cards that are drawn form a combination as defined below:

1) the last five cards forming a sequence, with regard to/regardless of the order they are drawn, e.g., A,2,3,4,5 or 9,10,J,Q,K;

2) five cards of a kind, e.g. A,A,A,A,A or 2,2,2,2,2;

3) four cards of a kind, with regard to/regardless of the order they are drawn, e.g., K,K,K,K,2 or 2,10,10,10,10;

4) three cards of a kind plus a pair, regardless of the order they are drawn, e.g., 2,2,2,J,J;

5) three cards of a kind, regardless of the order they are drawn, e.g., 2,2,2,10,Q;

6) two pairs, regardless of the order they are drawn, e.g., Q,Q,A,10, 10;

7) all the 5 cards of the same symbols (same suit): spade, heart, club or diamond; e.g., A(spade),10 (spade),J(spade), K(spade), Q(spade); or 8) any other specific combination of five cards as specified from time to time, (C) if the last four cards that are drawn form a combination as defined below:

1) the last four cards forming a sequence, with regard to/regardless of the order they are drawn, e.g., A,2,3,4, or 10,J,Q,K;

2) the last four cards of a kind, e.g. A,A,A,A or 10,10,10,10;

3) three cards of a kind, with regard to/regardless of the order they are drawn, e.g., K,K,K,2 or 10,10, 10,2;

4) two cards of a kind plus a pair, regardless of the order they are drawn, e.g., A,A,J,J, which is a two pair sequence;

5) two cards of a kind, regardless of the order they are drawn, e.g., 2,2,Q,Q;

6) all the four cards of the same symbols (same suit): spade, heart, club or diamond, e.g., A(spade),10 (spade),K(spade), Q(spade); or 7) any other specific combination of the first four cards as specified from time to time, (D) if the last three cards that are drawn form a combination as defined below:

1) the last three cards forming a sequence, with regard to/regardless of the order they are drawn, e.g., A,2,3, or J,Q,K;

2) the last three cards of a kind, e.g. A,A,A or Q,Q,Q;

3) two cards of a kind, with regard to/regardless of the order they are drawn, e.g., K,K,2 or 10,10,2;

4) two cards forming a pair, with regard to/regardless of the order they are drawn, e.g., 2,J,J or J,J,2;

5) all the last three cards of the same symbols (same suit): spade, heart, club or diamond, e.g., A(spade),J(spade),K(spade); or 6) any other specific combination of the first four cards as specified from time to time, (E) if the last two cards that are drawn form a combination as defined below:

1) the last two cards forming a sequence, with regard to/regardless of the order they are drawn, e.g., A,2, or 10,J;

2) the last two cards of a kind, e.g. A,A or 2,2, which is also a pair;

3) the last two cards of the same symbols (same suit): spade, heart, club or diamond, e.g., A(spade),10 (spade); or 4) any other specific combination of the first four cards as specified from time to time.

The combinations of cards not defined above can be readily derived from time to time with or without the assistance of a computer following established rules of forming combinations of a set of defined members. The amount of Paradise Jackpot™ award can be determined by and distributed according to, e.g., the probability of a combination of cards as defined above or otherwise specified from time to time.

There may be more than one live baccarat game going on simultaneously in different casinos in Macau. In some embodiments, all Paradise Jackpot™ bets from different live baccarat tables will contribute to one grand Paradise Jackpot™ pool. If the Paradise Jackpot™ is won in any one live baccarat table, all players who place Paradise Jackpot™ bets, regardless of the live baccarat table they bet, will share the grand Paradise Jackpot™ pool according to the bet units that each player placed in the jackpot betting.

Paradise Jackpot™ can be played with bets from players as the sole source of the jackpot pool or with bets and an initial contribution from the banker. The term "banker" generally refers to the owner of a gaming establishment operating the live baccarat defined herein or one who operates the live baccarat game. In one embodiment, the banker contributes a sum of money as the initial Paradise Jackpot™ (e.g., HKD 50,000). A certain percentage, e.g., 55%, of the Paradise Jackpot™ bets from the players will be contributed towards the Paradise Jackpot™ pool, a certain percentage (e.g., 40%) of the bets will be collected by the banker as profit, and the remaining portion (e.g., 5%) of the bets will be accumulated as the seed for the next game.

An embodiment of the general gaming method described herein is shown in the flowchart in FIG. 1. The flowchart shows the steps in playing the live baccarat games described herein. Step 110 shows the baccarat is ready to start a game. In step 120, the dealer presses the Start button on the baccarat machine to count-down the time for accepting bets. In step 130, the betting terminal, BU, accepts bets. Step 140 shows that the time for accepting bets is over and the dealer press the Cut-off button on the machine. In step 150, the server, which is also referred to as betting computation and track record central processing unit (BCPU), receives all bets from betting terminals. The dealer then obtains and displays cards in step 160. In step 170, the baccarat game gives results and the dealer presses approve button, approving the card dealing made, game results and payouts. The server, BCPU, then computes and distributes wins in step 180. The live baccarat game is over, as shown in step 190, and the machine is ready for next round of baccarat game that begins with step 110.

In another aspect of the present invention, it is provided a software program or a set of software programs that allows a user or player to any or all of the various aspects of playing the live baccarat Paradise Jackpot™ described herein. The software program can be written by one of ordinary skill in the art.

Gaming System

Figure 2:
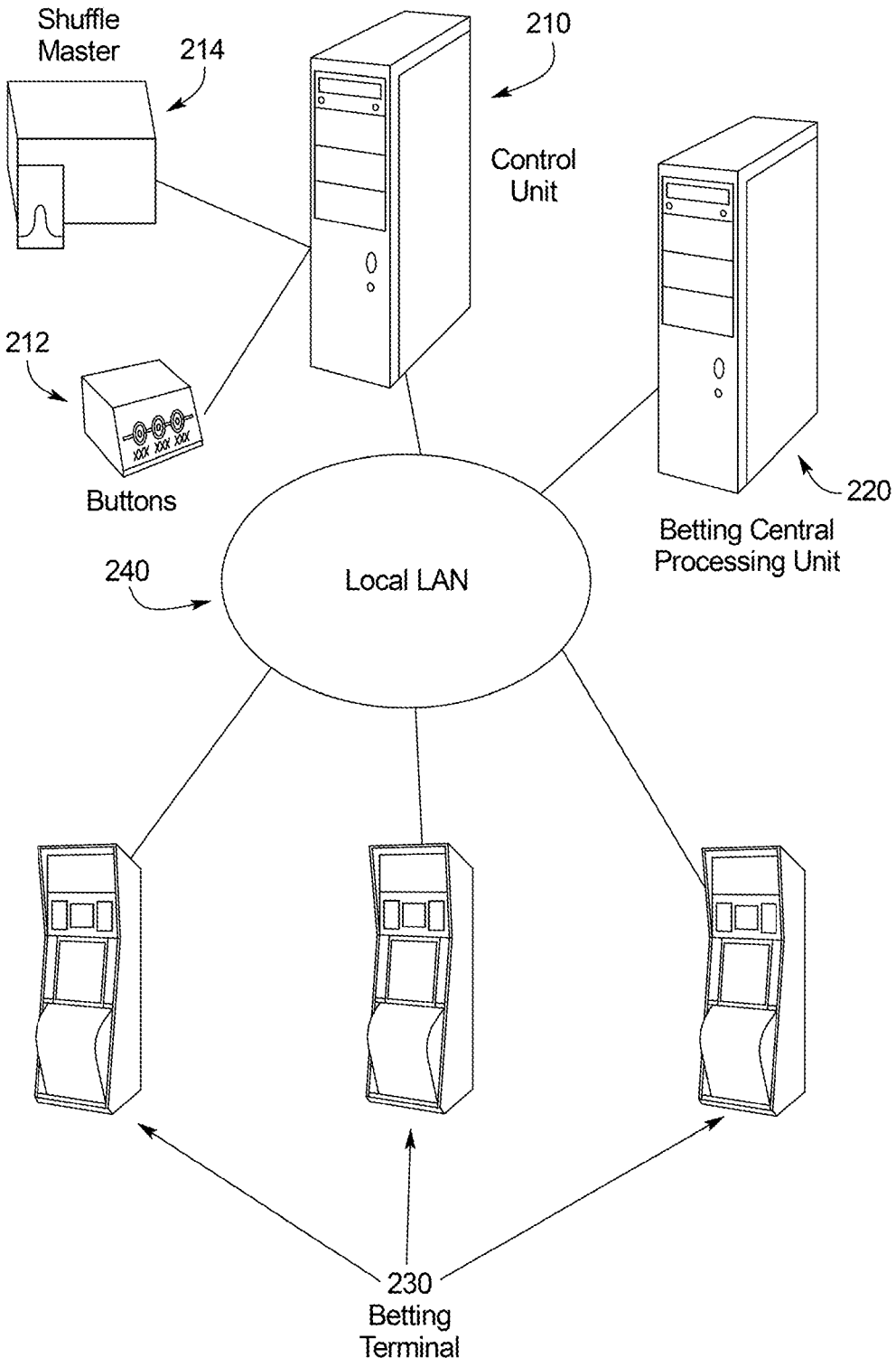
FIG. 2 shows a system embodying live baccarat jackpot of the present invention.

One aspect of the present invention provides a baccarat gaming system that allows one to play the live baccarat jackpot described herein. One embodiment of the present invention is shown in FIG. 2. Referring FIG. 2, the baccarat gaming system includes three members: (1) the control unit for automatic shuffle mechanism (CU) (210), (2) betting computation and tract record central processing unit (BCPU) (220), and (3) betting terminal for players (BT) (230) (FIG. 2). The control unit 210 may further contain control buttons (212) that allows the dealer to control the shuffling mechanism, which can be manual or automatic, and/or a shuffle master (214), which can be manual or automatic, for shuffling the cards. The CU 210 can include any or all of the components which may include control buttons that allow input from dealer and/or capable of (1) receiving the shuffle mechanism input, (2) sending visual output to a screen, and/or (3) sending card results in the player hand and/or bank hand to BCPU 220. The BCPU 220 has components or members capable of performing any or all of (1) receiving betting from BT (230), (2) receiving card results from CU 210, (3) sending betting results to BT 230, and/or (4) sending credit to BT 230.

The betting terminal for players, BT 230, has components or members capable of performing any or all of (1) sending betting to BCPU 220, (2) receiving betting results from BCPU 220, and/or (3) receiving credit from BCPU 220. Note, the baccarat gaming system can have a number of betting terminals, depending on the need of a gaming establishment. For example, if desirable, the baccarat gaming system can have 1, 2, 3, 4, 5, 6, 7, 8, 9, or 10, up to, e.g., 50 or 250 BTs. CU 210, BCPU 220, and BT 230 can be linked together via a local area network (LAN) (240) to form a baccarat gaming network between one, two, three or several gaming establishments.

The live baccarat game can have different variations. For example, the game can be played separately as a single live baccarat game. In some embodiments, the individual baccarat games as played in each betting terminal can be linked together. The individual games can all be played in a casino or gaming establishment or in several casino or gaming establishments. The individual games played in different betting terminals can be the same or different. Therefore, some or all of the baccarat games played in individual betting terminals, which can be the same or different baccarat games, can be linked together for a single jackpot.

Figure 3:
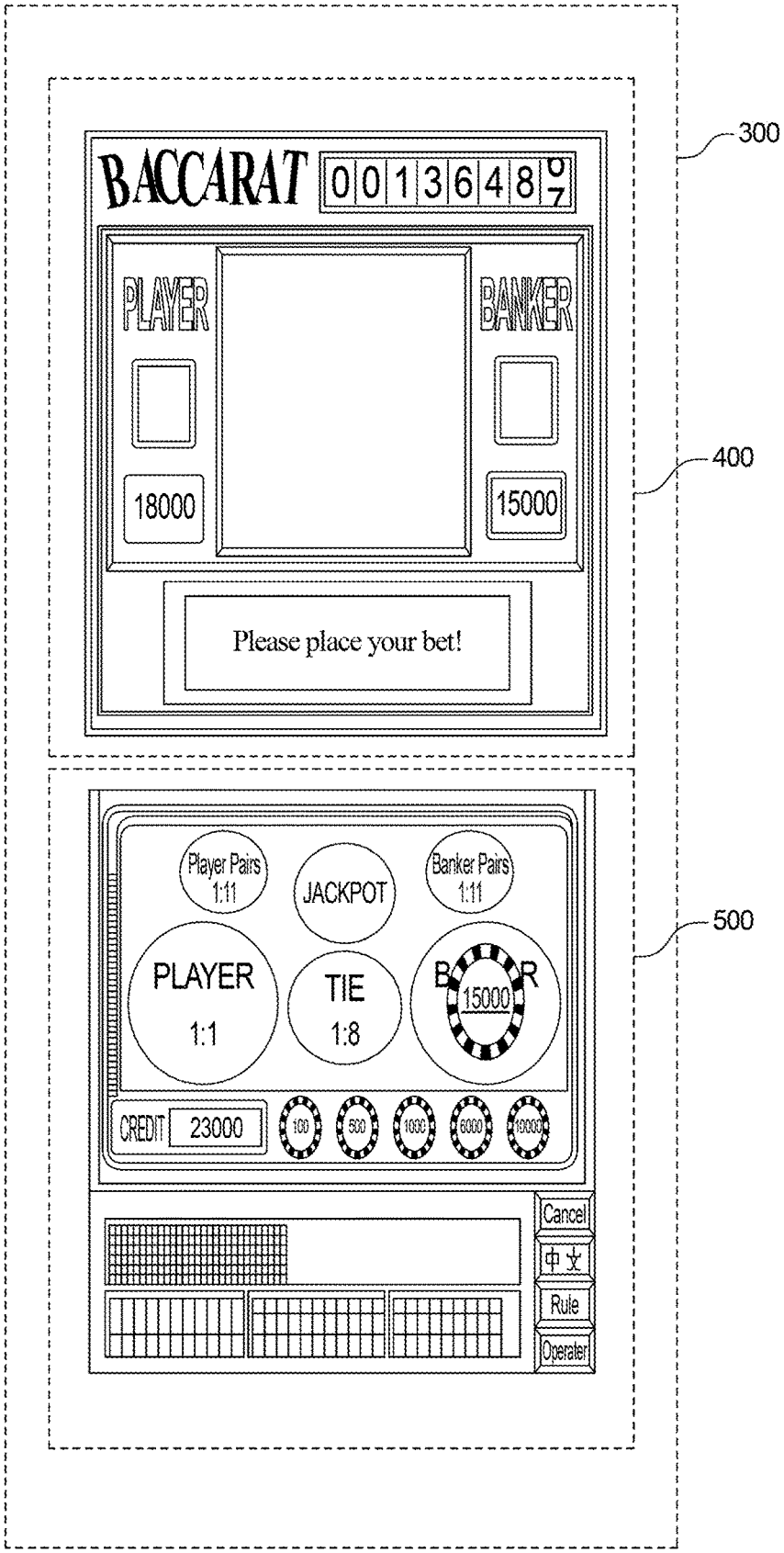
FIG. 3 shows the general layout of a baccarat machine.
Figure 4A:
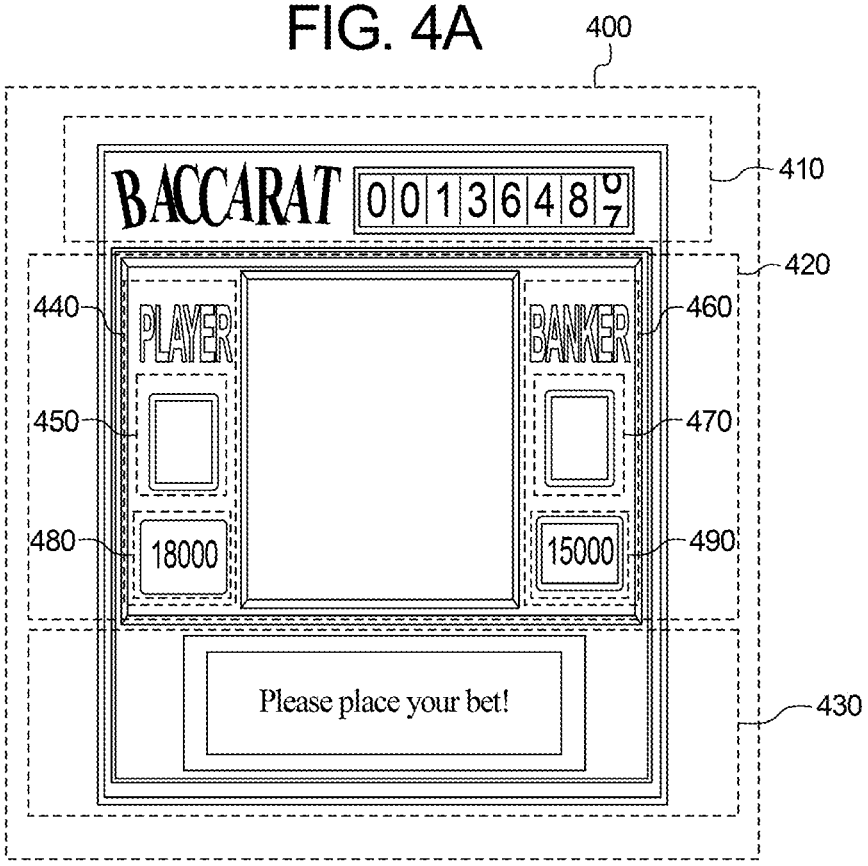
FIGS. 4A and 4B show the detailed layout of the betting terminal of a baccarat machine.
Figure 4B:
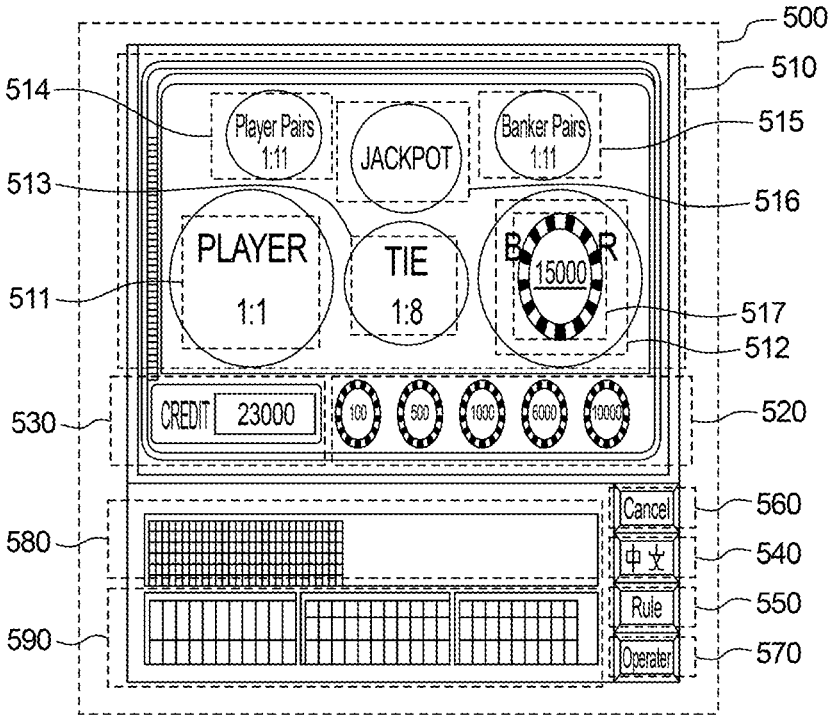

A layout for the live baccarat game described herein is shown in FIGS. 3, 4A and 4B. FIG. 3 shows the overall layout of the betting terminal (300), which has two screens, the upper screen (400) and the lower screen (500), shown in detail in FIGS. 4 and B. Referring to FIG. 4A, upper screen 400 includes an upper part (410) for displaying the result, score and latest jackpot amount, the center part (420) for displaying a live video of the gambling table, and a messenger screen (430) for displaying messages. In one embodiment, the jackpot amount digits can be programmed to be in rolling motion to reflect the increasing jackpot pool. The center part of the upper screen has a section designated as Player (440), which has a small screen (450), and another section designated as Banker (460), which also has a small screen (470). The small screens 450 and 470 are for display of card values of the player hand and the bank hand respectively. The current limits available for betting on on Player (player hand) and Banker (bank hand) in a live baccarat game are shown in small screens 480 and 490 below small screens 450 and 470, respectively.

Referring to FIG. 4B, the lower screen 500 is an operating touch screen for betting, which includes bet-option buttons (510), bet-amount buttons (520), and credit window (530). The bet-option buttons 510 include the various betting selections described above, e.g., betting for player hand (511) win with a payoff rate of 1:1, for the bank hand (512) win with a payoff rate of 1:0.95, for tie (513) with a payoff rate of 1:8, for Player Pairs (514) with a payoff rate of 1:11, for banker pairs (515) with a payoff rate of 1:11, and for Jackpot bet (516), the rules of which are described above. Box 517 shows the pops up when bets are placed on a particular bet option. The number inside Box 517 corresponds to the amount placed on a particular bet option. The bet-amount buttons 520 as shown in the layout, 100, 500, 1000, 5000, 10000, provide the players the convenience of adding up betting amounts in a fast manner. To illustrate, for a bet of 10,000 USD or HKD, the player can simply press the "1000" button ten times to reach the desired betting amount. Note, the bet-amount buttons 520 shown are illustrative and non-exclusive. Buttons designated for other amounts, e.g., "1", "5", "10", "100", "100,000", "1,000,000" can be readily added to the screen. The credit window 530 shows the remaining balance of a player's credit. The player may insert bills or chips into or transfer money from a credit card account and/or a bank account to the machine to add up the credit amount from time to time. If the player desires to stop playing the baccarat game and to cash out, he may ask the operator to authorize a cash-out procedure, and then obtain the remaining balance.

Still referring to FIG. 4, the lower screen 500 further includes language selection button (540), which can switch the operation language of the baccarat game between, e.g., English, Portuguese, Italian, French, Spanish, Russian, German, Arabic, Japanese, and Korean, etc, Rule selection button (550), which prompts the display of rules for live baccarat and Paradise Jackpot™, Cancel button (560), which allows the bettor to cancel all bets made before the cards are dealt, Operator button (570), which allows the bettor to call for assistance from the casino staff when there is machine failure or the bettor wishes to exit from the game, and Results Bars (580, 590) which display the results for previous live baccarat games. Once results of a game are confirmed, the losing bet shown in the bet option buttons (510) in the center of lower screen will disappear while the winning bet in the bet option buttons (510) in the lower screen will flash with the total amount won.

Figure 4C:
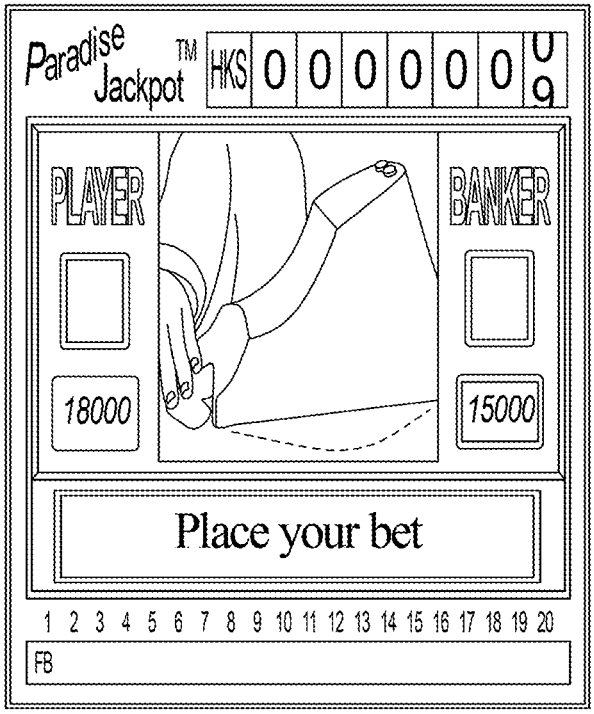
FIGS. 4C and 4D show a variant of the layout of the betting terminal shown in FIGS. 4A and 4B.

FIG. 4C is an alternative design of the upper screen 400 as shown in FIG. 4A, which has a similar layout as the one shown in FIG. 4A except that the top right corner of the upper screen displays the words "Paradise Jackpot™", and the bottom rim has a blank bar and numbers 1 through 20 on top of the bar.

Figure 4D:
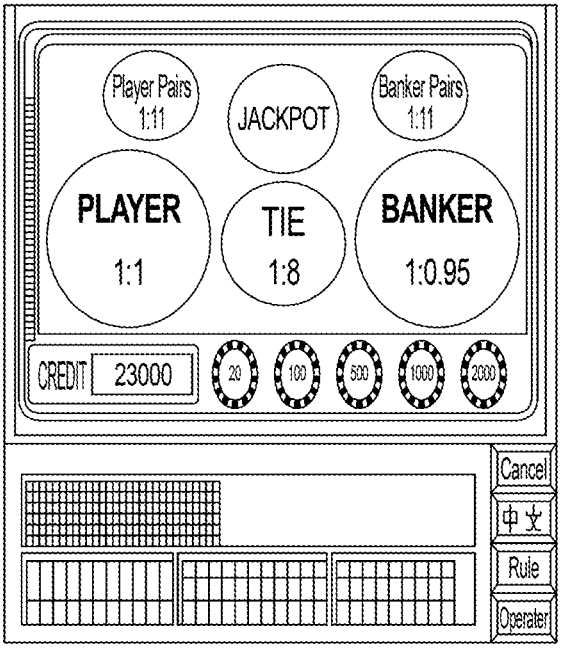

FIG. 4D is an alternative design of the lower screen of 500 as shown in FIG. 4B, which as a similar layout as the one shown in FIG. 4B except that the top rim of the lower screen 500 bears letters indicating the left side as the Player side and the right side and the Banker side, a screen at the far up-left corner indicating the maximum bet on the player hand accepted by the dealing table in a game, and a screen at the far up-right corner indicating the maximum bet on the banker hand accepted by the dealing table in a game.

Figure 5:
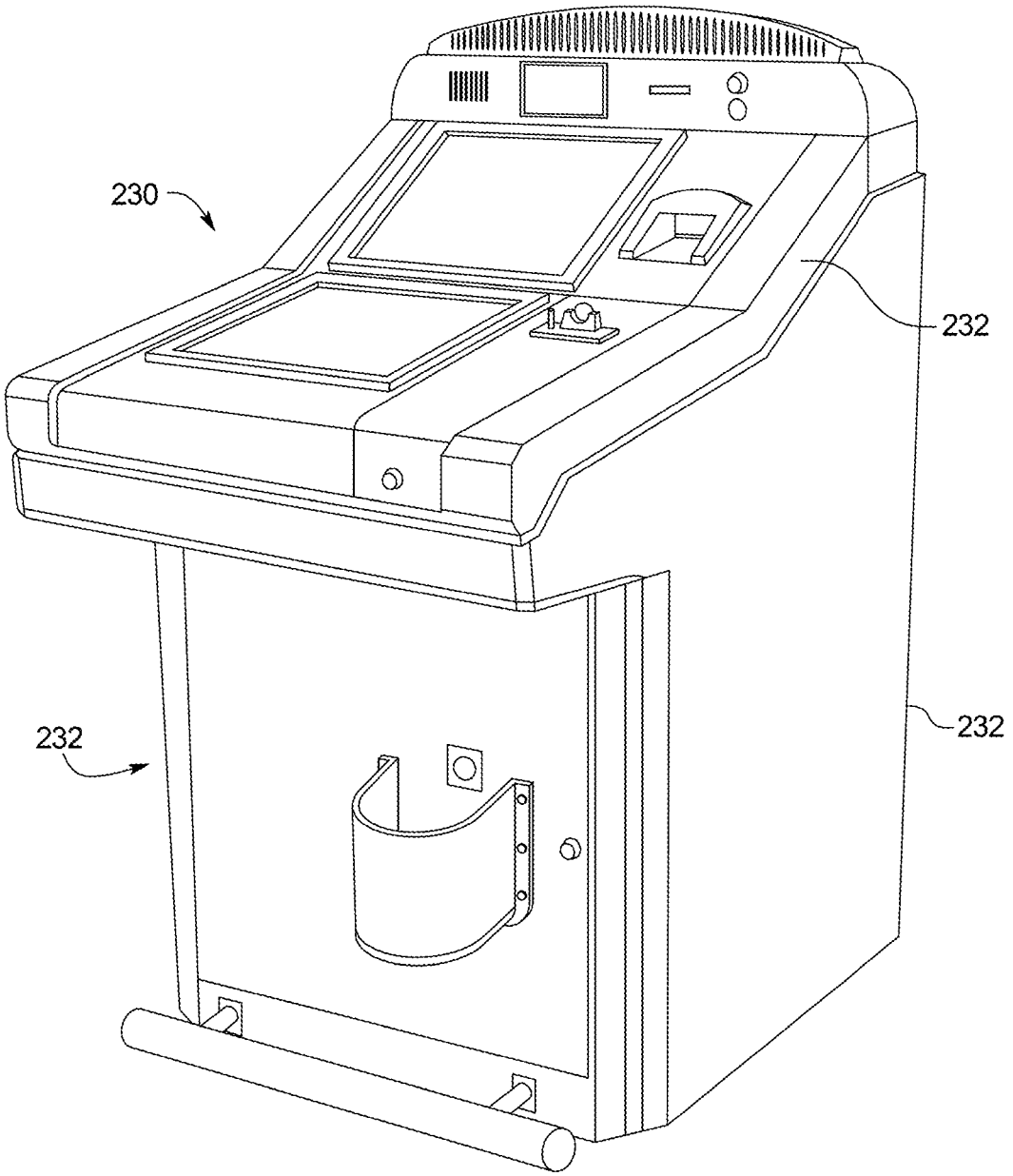
FIG. 5 shows an embodiment of the overall design of the betting terminal.
Figure 6:
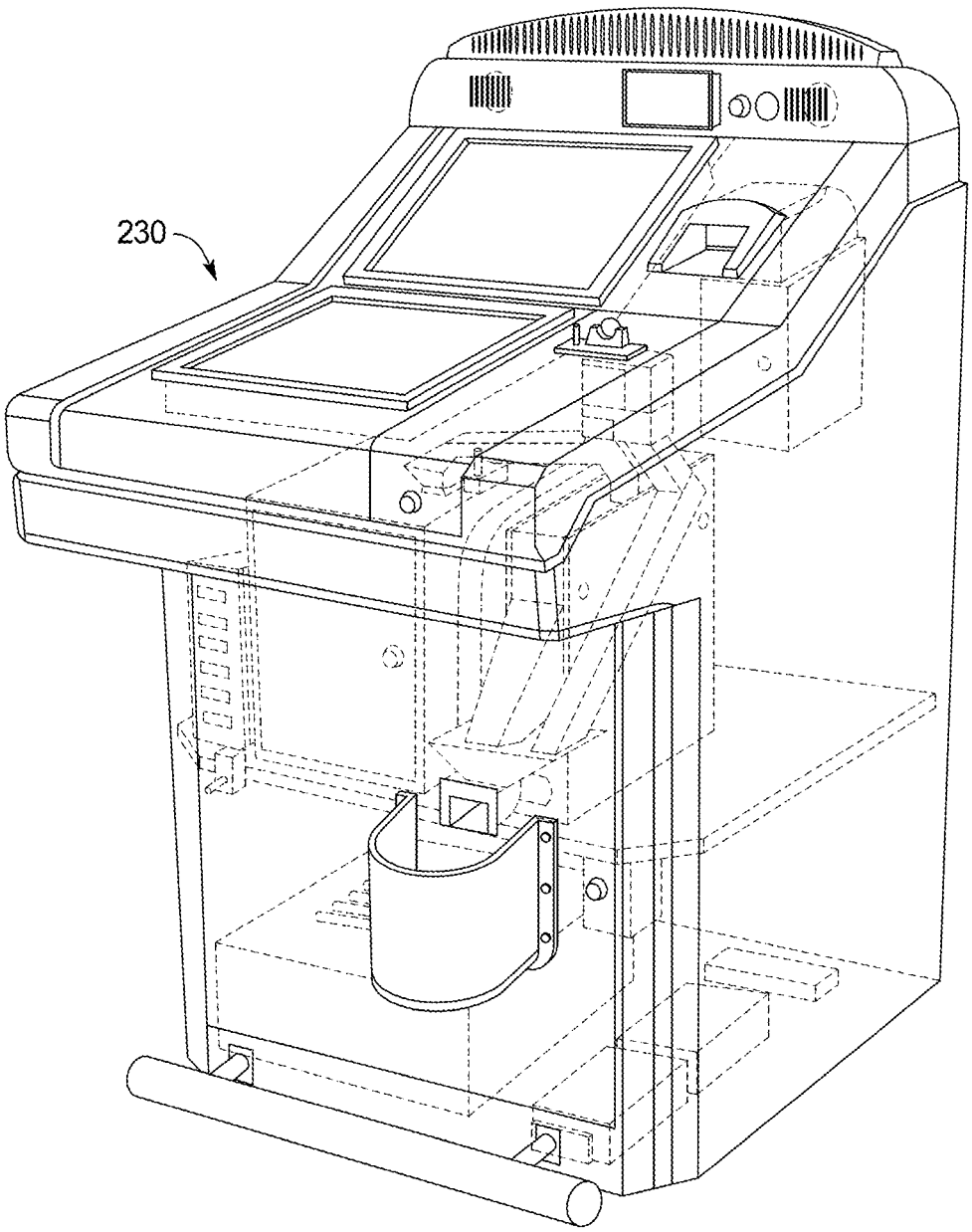
FIG. 6 shows another embodiment of the overall interior design of the betting terminal.

FIGS. 5 and 6 show two embodiments of the betting terminal (BT) 230. FIG. 5 shows an embodiment of BT 230 that has an opaque cover 232. FIG. 6 shows an embodiment of the interior design of BT 230.

Figure 7:
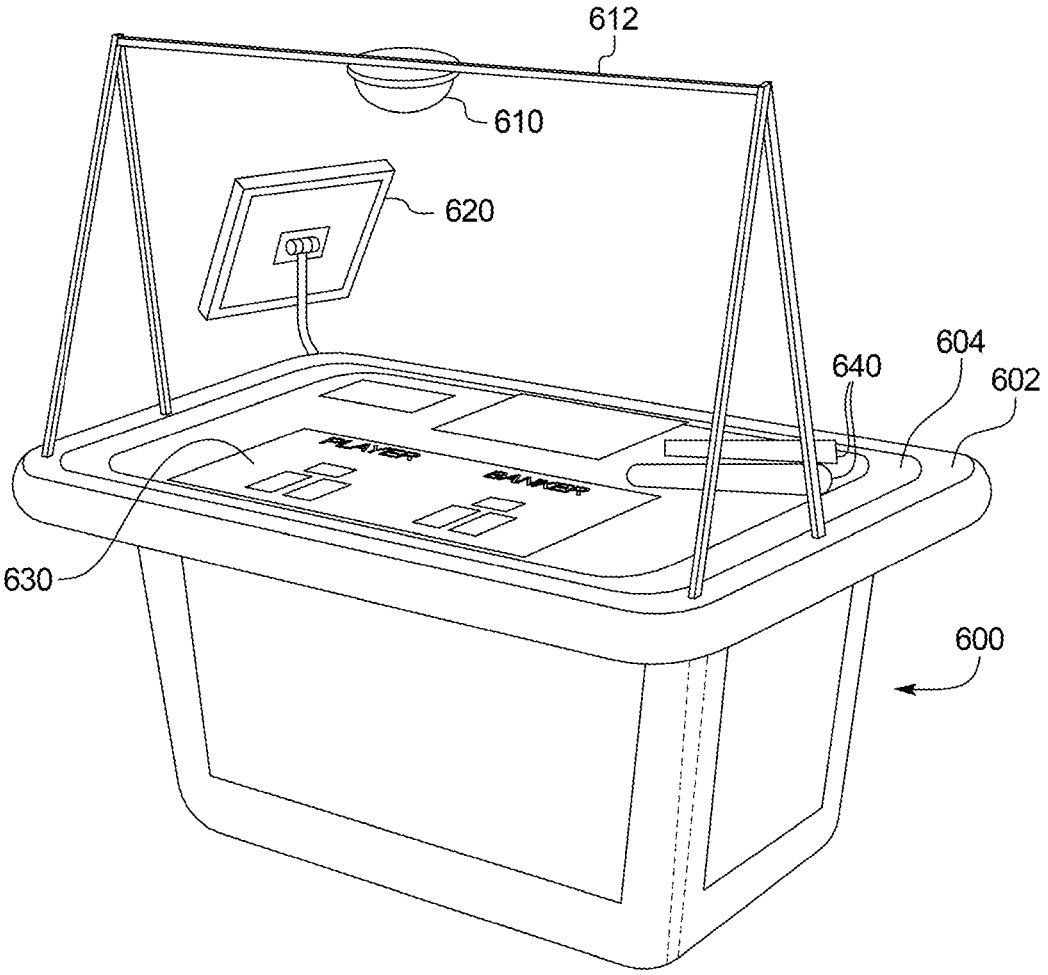
FIG. 7 shows an embodiment of the design of the dealing table.

In some embodiments, the gaming system includes a dealing table. An embodiment of the dealing table is shown in FIG. 7, which includes a main body 600, an overhead video camera 610 supported by a handle 612, a signaling mechanism (e.g., a touch screen) 620 for prompting the dealer of the dealing process, a lighting mechanism 630 for indication of the order the card dealing process, and rings 640 marking the space for placing the card shuffle master and box for disposal of played cards. The main body 600 has an outer rim 602 and inner rim 604.

Figure 8:
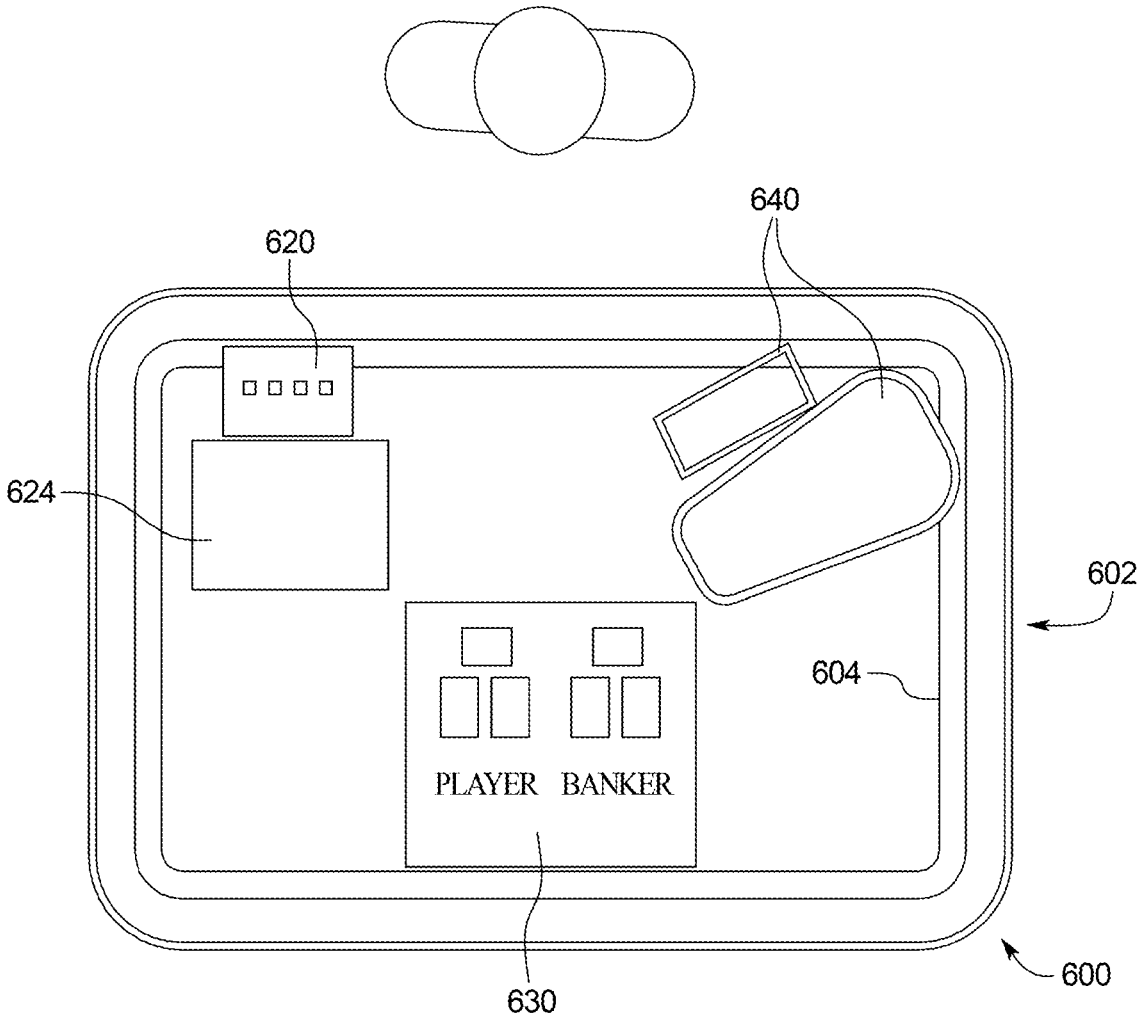
FIG. 8 shows an embodiment of the layout of the dealing table.

Another embodiment of the dealing table is shown in FIG. 8, which has a main body (DT 600), a touch screen 620 that includes a screen 622 and a pop up mechanism 624 for the touch screen, a lighting mechanism 630, and rings 640 marking the space for placing the card shuffle master and box for disposal of played cards. The main body 600 has an outer rim 602 and inner rim 604. In one embodiment, the main body 600 of the dealing table shown in FIG. 8 has an overall dimension of 1600 mm×1000 mm, the outer rim having an outer dimension of 1600 mm×1000 mm and an inner dimension of 1440 mm×840 mm, and the inner rim having an outer dimension of 1440 mm×840 mm and an inner dimension of 1350 mm×750 mm. The touch screen 620 includes a screen 622 having a dimension of 220 mm×130 mm and a pop up mechanism 624 having a dimension of 275 mm. The lighting mechanism has a dimension of 500 mm×400 mm.

Figure 9:
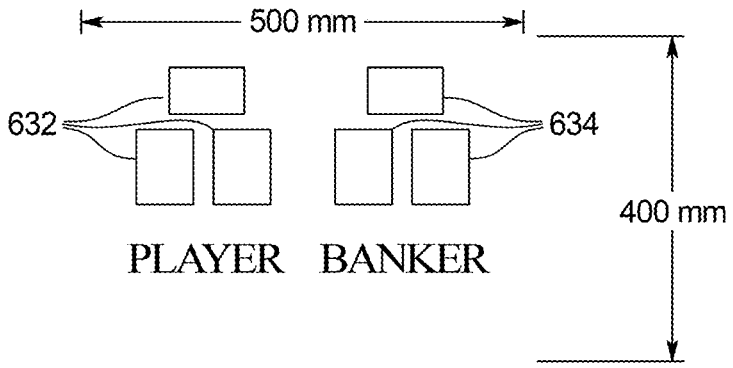
FIG. 9 shows an embodiment of the layout of the dealing table having lights indicating the order of the card dealing process.

FIG. 9 shows an embodiment of the lighting mechanism 630 of the dealing table as shown in FIG. 7 or 8. The lighting mechanism 630 includes lighting 632 indicating the next card shall be dealt to the Player and lighting 634 indicating the next card shall be dealt to the Banker. In one embodiment, the lighting mechanism can have a dimension of 500 mm×400 mm.

Figure 10:
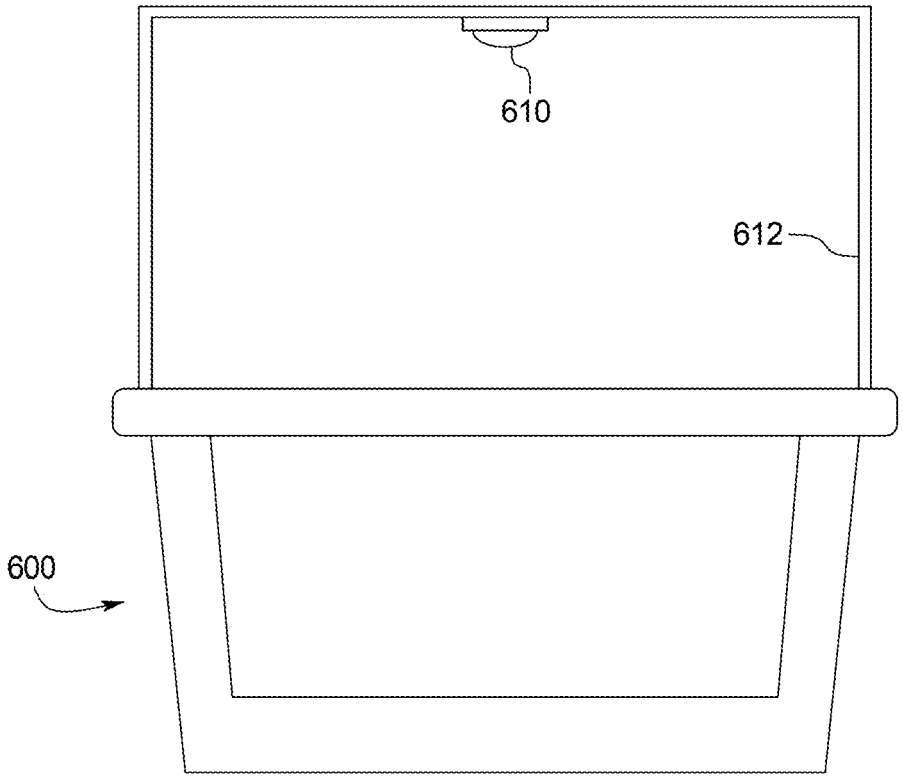
FIG. 10 shows the side view of a design of the dealing table.

FIG. 10 shows a side view of an embodiment of the dealing table of the present invention, which shows the main body 600 and the overhead video camera 610 supported by handle 612. In one embodiment, the main body 600 can have a length of 1600 mm and a height of 850 mm, and handle 612 can have a height of 850 mm.

Figure 11:
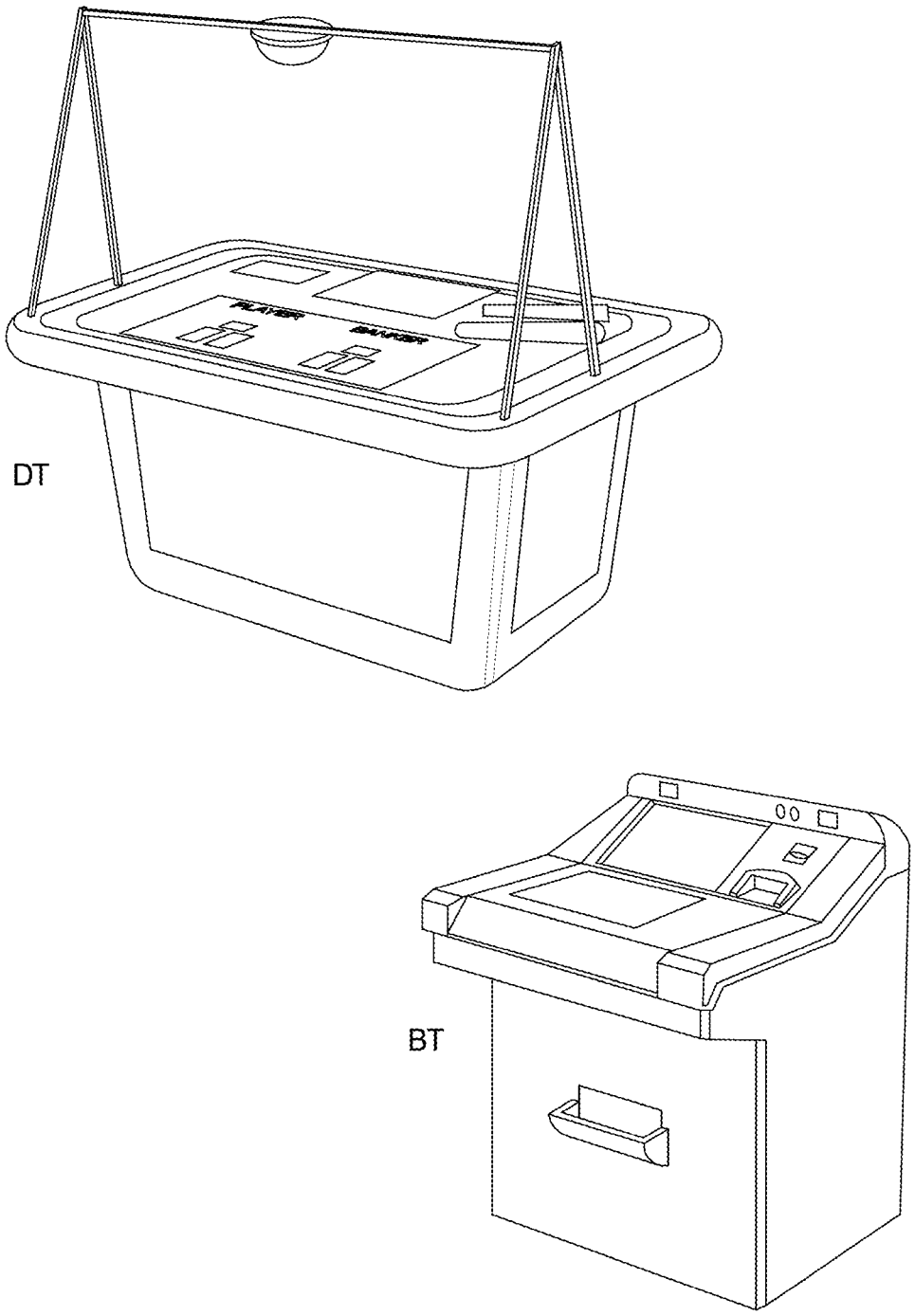
FIG. 11 shows an embodiment of the overall layout of betting terminals and the dealing table.
Figure 12:
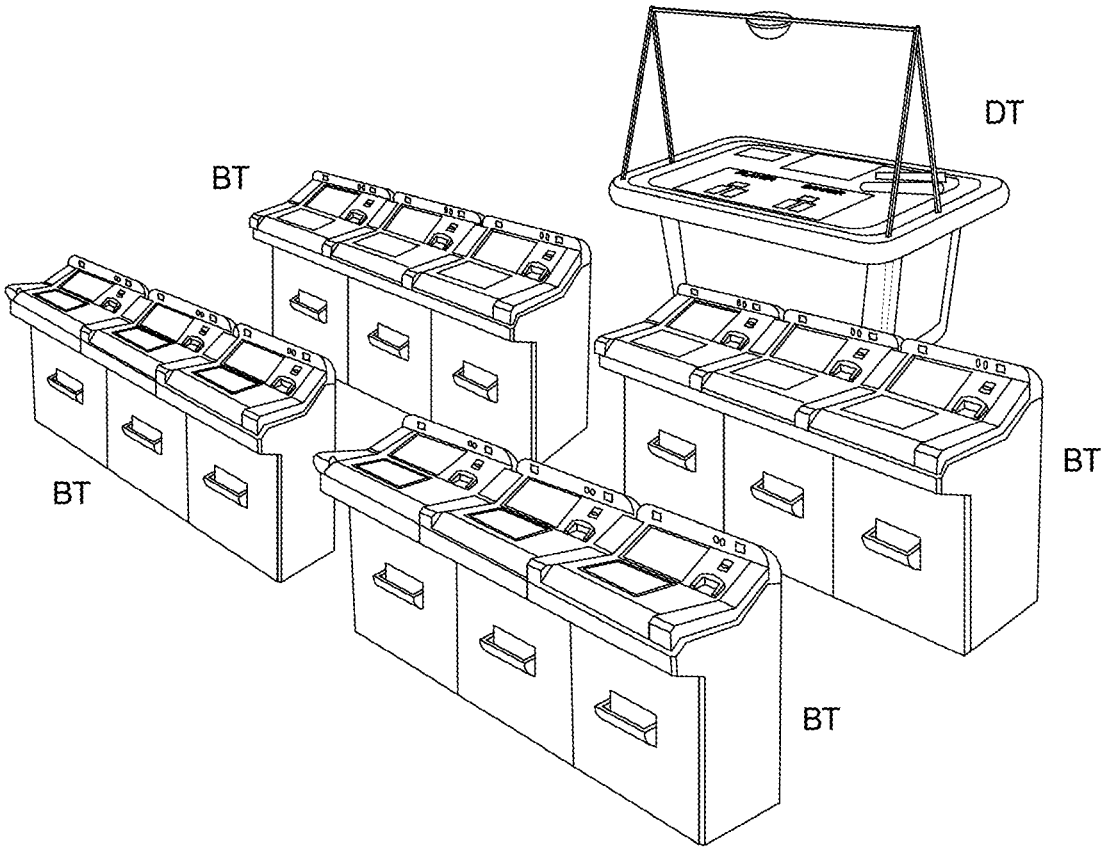
FIG. 12 shows an embodiment of one design of the Live Baccarat of present invention.
Figure 13:
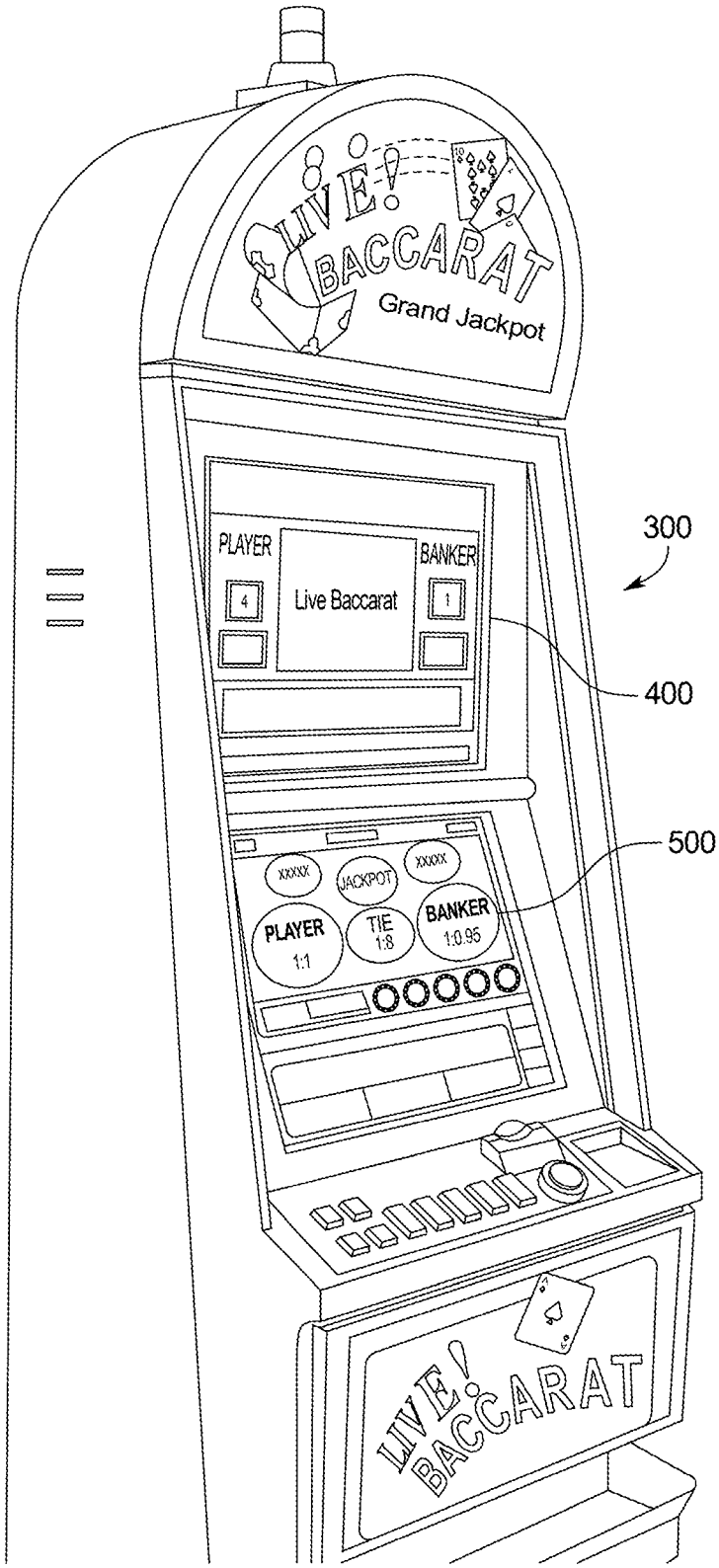
FIG. 13 shows an embodiment of another design of the Live Baccarat betting terminal of the present invention.

FIG. 11 shows an embodiment of the gaming system of the present invention that includes a dealing table and a betting terminal. FIG. 12 shows the overall layout of an embodiment of the gaming system of the present invention, which includes a dealing table and a plurality of betting terminals. FIG. 13 shows the overall layout of a further embodiment of the gaming system of the present invention.

In some other embodiments, the baccarat jackpot game can be played in an entertainment setting, e.g., in the form of game device such as laptop or desktop computers.

In a further embodiment, the baccarat jackpot game can be played in a non-baccarat game, e.g., blackjack, or showhand. The rules of these games other than baccarat games are known to one in the art.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

The invention is claimed as follows:

1. A method of operating a gaming system, the method comprising:

receiving data associated with an input of a start command, in response to receiving the data associated with the input of the start command, initiating, by a server, a countdown time for accepting bets on a play of a live baccarat game taking place at a first gaming table of a plurality of gaming tables, displaying, by a display device at each of a quantity of betting terminals remote from the first gaming table, the countdown time for accepting bets, the quantity of betting terminals exceeding a quantity of betting positions located at the first gaming table, receiving data associated with a bet on a play of the live baccarat game from a first player at a first betting terminal of the quantity of betting terminals, independent of any bet placed for the play of the live baccarat game by a second player at a second, different betting terminal of the quantity of betting terminals receiving data associated with a separate bet on a jackpot during the countdown time from the second player wherein the second player is different from the first player, and the second, different betting terminal has a player betting display area including a plurality of touch screen inputs, after receiving any bets on the play of the live baccarat game taking place at the first gaming table and any separate bets on the jackpot and subsequent to receiving data associated with an input that the countdown time is over:

displaying, in a video display area of the display device of the second betting terminal and based on data obtained via an overhead video camera associated with the first gaming table capturing images of a plurality of physical playing cards dealt at the first gaming table, video associated with a player hand of cards and a bank hand of cards of the play of the live baccarat game taking place at the first gaming table, displaying, in a player hand display area of the display device of the second betting terminal, video associated with player hand card values of the player hand from the first gaming table, said player hand card values being determined based on the data obtained via the overhead video camera associated with the first gaming table, and displaying, in a bank hand display area of the display device of the second betting terminal, video associated with bank hand card values of the bank hand from the first gaming table, said bank hand card values being determined based on the data obtained via the overhead video camera associated with the first gaming table, determining, by the server, an outcome of the play of the live baccarat game taking place at the first gaming table, after determining the outcome of the play of the live baccarat game, determining, by the server, an outcome of the jackpot, wherein the outcome of the jackpot is determined according to the cards drawn, including at least one of any zero-point cards drawn, in association with the play of the live baccarat game taking place at the first gaming table, and the bets received on the plays of live baccarat games at the plurality of gaming tables contribute to the jackpot, displaying the outcome of the play of the live baccarat game on the display device of the first betting terminal, and displaying the outcome of the jackpot on the display device of the second betting terminal.

2. The method of claim 1, wherein a banker who operates the play of the live baccarat game at the first gaming table makes an initial contribution to the jackpot.

3. The method of claim 1, wherein the play of the live baccarat game is according to Las Vegas baccarat rules.

4. The method of claim 1, wherein the play of the live baccarat game is according to Macau baccarat rules.

5. The method of claim 4, wherein the bet on the live baccarat game is selected from the group consisting of: a bet on a player hand win, a bet on a bank hand win, a tie bet, a bet on a player pair, and a bet on a bank pair, where one of the bet on the player hand win and the bet on the bank hand win can combine with at least one of: the tie bet, the bet on the player pair and the bet on the bank pair.

6. The method of claim 1, wherein the outcome of the jackpot is based on a combination of cards including an ace card, a king card, a queen card, a jack card and a ten card, regardless of the suit.

7. The method of claim 5, wherein the outcome of the jackpot is based on a combination of cards including the ace card, the king card, the queen card, the jack card and the ten card in spade, regardless of the sequence.

8. The method of claim 5, wherein the outcome of the jackpot is based on a combination of cards including the king card, the queen card, the jack card and the ten card in spade and the ace card in one of: heart, club and diamond, regardless of the sequence.

9. The method of claim 1, wherein the video associated with the player hand of cards and the bank hand of cards comprises a live video.

10. The method of claim 1, wherein the play of the live baccarat game taking place at the first gaming table comprises a random determination based on the plurality of physical playing cards associated with the first gaming table.

* * * * *